US011674093B2

(12) United States Patent
Coleman et al.

(10) Patent No.: US 11,674,093 B2
(45) Date of Patent: Jun. 13, 2023

(54) TEMPERATURE CONTROL FOR CENTRIFUGATION OF STEAM CRACKED TAR

(71) Applicant: ExxonMobil Chemical Patents Inc., Baytown, TX (US)

(72) Inventors: John S. Coleman, Houston, TX (US); Kapil Kandel, Humble, TX (US); Michael J. Clemmons, Mont Belvieu, TX (US); Teng Xu, Houston, TX (US); Giovanni S. Contello, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 17/298,972

(22) PCT Filed: Dec. 11, 2019

(86) PCT No.: PCT/US2019/065704

§ 371 (c)(1),
(2) Date: Jun. 2, 2021

(87) PCT Pub. No.: WO2020/123634

PCT Pub. Date: Jun. 18, 2020

(65) Prior Publication Data

US 2022/0033720 A1 Feb. 3, 2022

Related U.S. Application Data

(60) Provisional application No. 62/779,627, filed on Dec. 14, 2018.

(51) Int. Cl.

| | |
|---|---|
| ***C10G 31/10*** | (2006.01) |
| ***C10G 55/04*** | (2006.01) |
| ***C10G 69/06*** | (2006.01) |

(52) U.S. Cl.

CPC ..... *C10G 55/04* (2013.01); *C10G 69/06* (2013.01); *C10G 2300/201* (2013.01); *C10G 2300/206* (2013.01); *C10G 2300/308* (2013.01); *C10G 2300/4006* (2013.01)

(58) Field of Classification Search

CPC ..... C10G 31/10

See application file for complete search history.

(56) References Cited

U.S. PATENT DOCUMENTS

| | | | | |
|---|---|---|---|---|
| 2,382,260 | A | 8/1945 | Schaad | |
| 4,572,781 | A | 2/1986 | Krasuk et al. | |
| 4,897,205 | A | 1/1990 | Landry | |
| 5,158,668 | A | 10/1992 | Chahar et al. | |
| 5,871,634 | A | 2/1999 | Wiehe et al. | |
| 9,771,524 | B2 | 9/2017 | Xu et al. | |
| 10,988,698 | B2 | 4/2021 | Kandel et al. | |
| 2015/0361354 | A1* | 12/2015 | Xu ..... | C10G 69/06 208/264 |
| 2015/0361359 | A1 | 12/2015 | Beech, Jr. et al. | |

FOREIGN PATENT DOCUMENTS

| | | |
|---|---|---|
| WO | 2013/033590 | 3/2013 |
| WO | 2019/203981 | 10/2019 |
| WO | 2019/236326 | 12/2019 |

OTHER PUBLICATIONS

U.S. Appl. No. 17/298,963, filed Jun. 2, 2021, Entitled "Solvent Control for Centrifugation of Steam Cracked Tar" Inventors: John S. Coleman et al.

* cited by examiner

*Primary Examiner* — Randy Boyer

(57) ABSTRACT

Processes for preparing a low particulate liquid hydrocarbon product are provided and includes blending a tar stream containing particles with a fluid to produce a fluid-feed mixture containing tar, the particles, and the fluid, and centrifuging the fluid-feed mixture at a temperature of greater than 60° C. to produce a higher density portion and a lower density portion, where the lower density portion contains no more than 25 wt % of the particles in the fluid-feed mixture.

25 Claims, 5 Drawing Sheets

TEMPERATURE CONTROL FOR CENTRIFUGATION OF STEAM CRACKED TAR

CROSS-REFERENCE TO RELATED APPLICATIONS

This application is a US national phase application of PCT Application Serial No. PCT/US2019/065704 having a filing date of Dec. 11, 2019, which claims priority to and the benefit of U.S. Provisional Patent Application Ser. No. 62/779,627 having a filing date of Dec. 14, 2018, the disclosures of which is incorporated herein by reference in their entireties.

FIELD OF INVENTION

Embodiments generally relate to improving hydrocarbon feedstock compatibility. More particularly, embodiments relate to processes which include subjecting a hydrocarbon feedstock to a centrifugal force to segregate problematic components of the feed into a separable, higher-density fraction, to the hydrocarbon products of such processes, and to equipment useful for such processes.

BACKGROUND OF INVENTION

Hydrocarbon pyrolysis processes, such as steam cracking, crack hydrocarbon feedstocks into a wide range of relatively high value molecules, including ethylene, propene, butenes, steam cracked gas oil ("SCGO"), steam cracked naphtha ("SCN"), or any combination thereof. Besides these useful products, hydrocarbon pyrolysis can also produce a significant amount of relatively low-value heavy products, such as pyrolysis tar. When the pyrolysis is produced by steam cracking, the pyrolysis tar is identified as steam-cracked tar ("SCT"). Economic viability of petrochemical processes relies in part on the ability to incorporate as much of the product and residual fractions, such as SCT, into the value chain. One use of residual fractions and/or relatively low value products is to blend these fractions with other hydrocarbons, e.g., with other feed streams or products.

SCT, however, generally contains relatively high molecular weight molecules, conventionally called Tar Heavies ("TH"), and an appreciable amount of sulfur. The presence of sulfur and TH make SCT a less desirable blend stock, e.g., for blending with fuel oil blend-stocks or different SCTs. Compatibility is generally determined by visual inspection for solids formation, e.g., as described in U.S. Pat. No. 5,871,634. Generally, SCTs have high viscosity and poor compatibility with other heavy hydrocarbons such as fuel oil, or are only compatible in small amounts. Likewise, SCTs produced under specific conditions generally have poor compatibility with SCT produced under different conditions.

Viscosity and compatibility can be improved, and the amount of sulfur decreased, by catalytically hydroprocessing the SCT. Catalytic hydroprocessing of undiluted SCT, however, leads to appreciable catalyst deactivation and the formation of undesirable deposits (e.g., coke deposits or particles) on the reactor internals. As the amount of these deposits increases, the yield of the desired upgraded pyrolysis tar (upgraded SCT) decreases and the yield of undesirable byproducts increases. The hydroprocessing reactor pressure drop also increases, often to a point where the reactor is inoperable.

It is conventional to lessen deposit formation by hydroprocessing the SCT in the presence of a fluid, e.g., a solvent having significant aromatics content. The product of the hydroprocessing contains an upgraded SCT product that generally has a decreased viscosity, decreased atmospheric boiling point range, and increased hydrogen content over that of the feed's SCT, resulting in improved compatibility with fuel oil blend-stocks. Additionally, hydroprocessing the SCT in the presence of fluid produces fewer undesirable byproducts and the rate of increase in reactor pressure drop is lessened. Conventional processes for SCT hydroprocessing are disclosed in U.S. Pat. Nos. 2,382,260 and 5,158,668; and in International Pat. Appl. Pub. No. WO 2013/033590, which involves recycling a portion of the hydroprocessed tar for use as the fluid.

The presence solid or semi-solid material in SCT represents a significant challenge to effective SCT hydroprocessing. An appreciable amount of the SCT's solids and semi-solids are in the form of particulates, e.g., coke (such as pyrolytic coke), oligomeric and/or polymeric material, inorganic solids (e.g., fines, metal, metal-containing compounds, ash, etc.) aggregates of one or more of these, etc. Although some SCT particulates can be removed by filtration or settling, these removal methods can significantly lengthen processing time. For example, solids removal by particle settlement can be slow and/or energy intensive, leading to the presence of large molecules even after settling. These problems are worsened when using economically-attractive SCT feeds, which can contain a significant amount of solids or particulates, such as high as a total solids content of 4,000 ppm or greater, and particles sizes ranging from submicron to greater than 1,000 microns.

Thus, there is a need for improved hydrocarbon conversion processes to produce a hydrocarbon for use, e.g., as a feed to hydroprocessing and/or as a fuel oil blend stock. There is also a need for tars such as SCTs having improved properties, including improved blending compatibility, decreased viscosity, and decreased sulfur content. More particularly, there is a need for improved SCT conversion processes that include decreasing the content of solids and semi-solids in the SCT, e.g., before hydroprocessing and/or blending.

SUMMARY OF INVENTION

The invention is based in part on the discovery that a separation can be carried out on a tar feed such as SCT under particular conditions that greatly decrease the content of solids and semi-solids, and especially particulates. Accordingly, in certain embodiments the invention relates to processes that include removal of solids and semi-solids from heavy hydrocarbon feed, e.g., tar, such as SCT, by separating at an elevated temperature certain higher density components (e.g., particles) that are present in the hydrocarbon feed an in the resulting fluid-feed mixture. The separation is carried out by transferring at least a portion of the particles present in the fluid-feed mixture to a higher density portion of the fluid feed mixture, and conduction away a purified (as compared to the fluid-feed mixture) a lower density portion. It has been found that doing so, e.g., at a temperature≥60° C., selectively removes certain higher density components (especially higher density particulates) in feed, and segregates the particles that tend to cause fouling of downstream catalysts and other portions of the process system. It has been observed for feeds comprising a mixture of tar and fluid (e.g., solvent, utility fluid, etc.), that separating a higher density portion from the tar feed by centrifuging at an elevated temperature results in a greater yield of a purified (lesser solids and semi-solids content), lower density portion of the tar-fluid mixture, e.g., a raffinate. The raffinate can be hydroprocessed long-term without undue increases in reactor pressure drop.

In one or more embodiments, a process for preparing a low-particulate liquid hydrocarbon product is provided and includes blending a tar containing particles with one or more fluids (e.g., utility fluid) to produce a fluid-feed mixture containing tar, the particles, and the fluid. The process further comprises centrifuging the fluid-feed mixture at a temperature of greater than 60° C. (e.g., greater than 60° C. to about 200° C.) to separate from the fluid-feed mixture a higher density portion and a lower density portion, where, where the weight ratio of the particulate content in the lower density portion: the particulate content in the fluid-feed mixture is ≤0.95, e.g., ≤0.90, such as ≤0.75, or ≤0.5, or ≤0.25, or ≤0.10.

In these and/or other examples, at least 10% (by weight) of particulates present in the fluid feed mixture are transferred to the higher density portion, e.g., at least 50 wt %, or at least 75 wt %, or at least 90 wt %, or at least 95 wt %, or at least 98 wt %. The transfer of particles from the fluid-feed mixture to the higher density portion is carried out with the liquid undergoing the separation (e.g., fluid-feed mixture undergoing centrifuging) a temperature≥60° C. The particles transferred to the higher density portion can be or include oligomeric and/or polymeric particles (including polymeric and/or oligomeric coke particles), pyrolytic coke particles, inorganic solids (e.g., fines, metal, metal-containing compounds, ash, etc.), aggregates, agglomerates, and/or other combinations of one or more of these, etc. In some examples, the particles contain polymeric coke particles that have a specific gravity of about 1.04 to about 1.1. Optionally, the method further includes heat soaking the tar and/or the fluid-feed mixture to decrease reactivity.

In another embodiment, a process for preparing a low particulate liquid hydrocarbon product is provided and includes blending a tar stream containing particles with a fluid to produce a fluid-feed mixture containing tar, the particles, and the fluid, where the fluid-feed mixture contains about 30 wt % or greater of the fluid based on a combined weight of the tar stream and the fluid, and where the fluid-feed mixture contains at least 500 ppmw of particles having a size of greater than 25 μm. The method also includes separating from the fluid-feed mixture at a temperature of greater than 60° C. a higher density portion and a lower density portion, wherein at least 25% (by weight) of the particles in the fluid-feed mixture are transferred from the fluid-feed mixture to the higher density portion.

In another embodiment, a process for preparing a low particulate liquid hydrocarbon product is provided and includes blending a tar stream with a fluid to produce a fluid-feed mixture containing ≤70 wt % of a tar containing solid or semi-solid particulates, wherein the fluid comprises ≥90 wt % of the balance of the fluid-feed mixture, e.g., ≥95 wt %, or ≥99 wt %. Such a fluid-feed mixture can comprise the tar and ≥30 wt % of the fluid, such as in the range of about 30 wt % to about 70 wt %, based on a combined weight of the tar stream and the fluid. The fluid-feed mixture contains at least 500 ppmw (based on the weight of the fluid-feed mixture) of particles having (i) a size of greater than 25 μm and (ii) a specific gravity≥1.04, e.g., in the range of from about 1.04 to about 1.5. The method also includes centrifuging the fluid-feed mixture at a temperature of greater than 60° C. to about 200° C. to produce a higher density portion and a lower density portion. The lower density portion contains less than 500 ppmw of the particles (based on the weight of the lower density portion), e.g., less than 400 ppmw, such as less than 300 ppmw, or less than 200 ppmw, or less than 100 ppmw.

Other embodiments include the hydrocarbon products of any of the foregoing processes, and mixtures containing any of such hydrocarbon products and a second hydrocarbon, particularly mixtures which are substantially free of precipitated asphaltenes.

In other aspects, embodiments relates to equipment and combinations thereof for use in any of the foregoing processes. Accordingly, some embodiments relate to an apparatus for upgrading a hydrocarbon feed, he apparatus including: (a) a hydrocarbon feed source in fluid communication with a fluid source to provide a fluid-feed mixture; (b) a first separation unit configured to receive the fluid-feed mixture, the separation unit containing a centrifuge capable of separating from the hydrocarbon feed a higher density portion and a lower density portion; and (c) removing at least the lower density portion. Particular aspects may optionally further include a hydroprocessing reactor in fluid communication with first separation unit, said hydroprocessing reactor capable of providing a hydroprocessed effluent from the lower density portion and further optionally a second separation unit for separating from the hydroprocessed effluent a fluid-enriched stream and a product stream. Certain aspects may also include (i) blending means, e.g., for blending at least a portion of the lower density portion with a fuel oil blend-stock, and/or a (ii) one or more conduits, the conduits being configured to convey the hydrocarbon products of any of the foregoing processes to other locations in the process, e.g., to recycle the fluid-enriched stream to the blending means.

These and other features, aspects, and advantages of the processes will become better understood from the following description, appended claims, and accompanying drawings.

DETAILED DESCRIPTION

Figure 1:
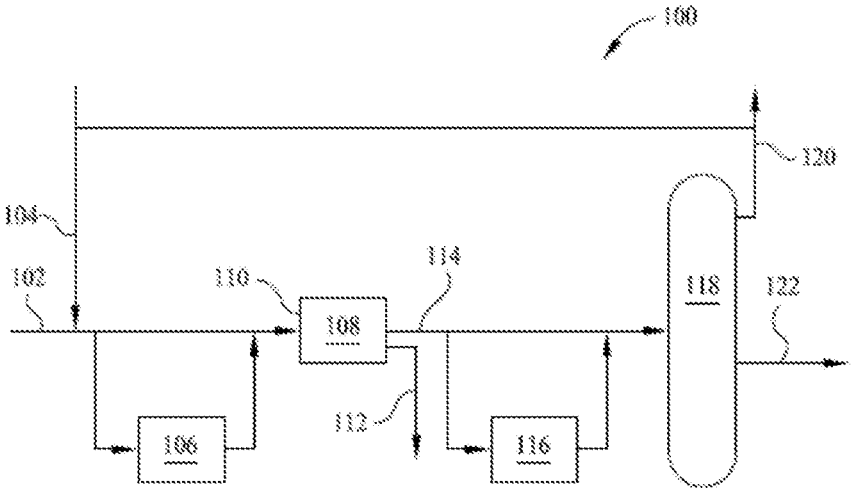
FIG. 1 depicts a process 100, according to one or more embodiments.

Certain aspects of the invention relate to removing certain higher density components (e.g., particles) as are present in a hydrocarbon feed, e.g., a tar feed, such as an SCT feed. In these and other aspects, the particles are removed by combining the hydrocarbon feed with a utility fluid (typically a solvent) to produce a fluid-feed mixture, and then subjecting the fluid-feed mixture to a centrifugal force (typically in one or more centrifuges), at a temperature≥60° C. to separate from the tar at least a higher density portion and a lower density portion. It has been found that for a wide range of hydrocarbon feeds, and in particular for a wide range of commercially advantageous SCTs, the temperature of the fluid-feed mixture can be regulated to optimize the transfer of particulates from the fluid-feed mixture to the higher density portion without an undue loss of hydrocarbon available for subsequent upgrading via hydroprocessing. Accordingly, the lower density portion, which comprises purified hydrocarbon (purified in the sense that at least a portion of any undesirable particles have been removed) can be conducted away for further processing, e.g., for hydroprocessing under hydrocarbon conversion conditions, such as SCT conversion conditions. In other words, maintaining the fluid-feed mixture at a temperature≥60° C. during centrifuging segregates and removes particles that would otherwise cause fouling of downstream catalysts and other portions of the process system, allowing for acceptable yields by leaving useful components in the lower density portion. In some embodiments, the process is based in part on the discovery that separation from the feed of a higher density portion, e.g., by controlling temperature during centrifuging, can increase the compatibility of the hydrocarbon feed to a greater extent while removing a relatively smaller amount of the feed, leading to a purer product stream containing one or more low particulate hydrocarbon products.

In one or more embodiments, a process for preparing a low particulate liquid hydrocarbon product is provided and includes blending a tar stream (such as an SCT stream) containing particles with one or more fluids (e.g., utility fluid) to produce a fluid-feed mixture containing tar, the particles, and the fluid, where the fluid-feed mixture contains about 30 wt % or greater (e.g., about 40 wt % to about 70 wt % or about 45 wt % to about 60 wt %) of the utility fluid based on a combined weight of the tar stream and the fluid. The process further comprises exposing the fluid-feed mixture at a temperature of greater than 60° C. (e.g., greater than 60° C. to about 200° C.) to a centrifugal force to separate from the fluid-feed mixture a higher density portion and a lower density portion. The lower density portion can contain, e.g., no more than 25% by weight of the particles in the fluid-feed mixture, based on the weight of the particles in the fluid-feed mixture.

Definitions

"Hydrocarbon feed" refers to a flowable composition, e.g., liquid phase, high viscosity, and/or slurry compositions, which (i) includes carbon bound to hydrogen and (ii) has a mass density greater than that of gasoline, typically ≥0.72 Kg/L, e.g., ≥0.8 Kg/L, such as ≥0.9 Kg/L, or ≥1.0 Kg/L, or ≥1.1 Kg/L. Such compositions can include one or more of crude oil, crude oil fraction, and compositions derived therefrom which (i) have a kinematic viscosity≤$1.5\times10^3$ cSt at 50° C., (ii) contain carbon bound to hydrogen, and (iii) have a mass density≥740 kg/m$^3$. Hydrocarbon feeds typically have a final boiling point at atmospheric pressure ("atmospheric boiling point", or "normal boiling point") ≥430° F. (220° C.). Certain hydrocarbon feeds include components having an atmospheric boiling point≥290° C., e.g., hydrocarbon feeds containing ≥20% (by weight) of components having an atmospheric boiling point≥290° C., e.g., ≥50%, such as ≥75%, or ≥90%. Certain hydrocarbon feeds appear to have the color black or dark brown when illuminated by sunlight, including those having a luminance≤7 cd/m$^2$, luminance being measured in accordance with CIECAM02, established by the Commission Internationale de l'eclairage. Non-limiting examples of such feeds include pyrolysis tar, SCT, vacuum residual fracturing, atmospheric residual fracturing, vacuum gas oil ("VGO"), atmospheric gas oil ("AGO"), heavy atmospheric gas oil ("HAGO"), steam cracked gas oil ("SCGO"), deasphalted oil ("DAO"), cat cycle oil ("CCO", including light cat cycle oil, "LCCO", and heavy cat cycle oil, "HCCO"), natural and synthetic feeds derived from tar sands, or shale oil, coal.

"SCT" means (a) a mixture of hydrocarbons having one or more aromatic components and optionally (b) non-aromatic and/or non-hydrocarbon molecules, the mixture being derived from hydrocarbon pyrolysis and having a 90% Total Boiling Point≥ about 550° F. (290° C.) (e.g., ≥90.0 wt % of the SCT molecules have an atmospheric boiling point≥550° F. (290° C.)). SCT can contain >50.0 wt % (e.g., >75.0 wt %, such as >90.0 wt %), based on the weight of the SCT, of hydrocarbon molecules (including mixtures and aggregates thereof) having (i) one or more aromatic components and (ii) a number of carbon atoms≥15. SCT generally has a metals content, ≤$1.0\times10^3$ ppmw, based on the weight of the SCT (e.g., an amount of metals that is far less than that found in crude oil (or crude oil components) of the same average viscosity). SCT typically has a mass density≥1.0 Kg/L, e.g., ≥1.05 Kg/L, such as ≥1.1 Kg/L, or ≥1.15 Kg/L.

"Solvent assisted tar conversion" or ("SATC") is a process for producing an upgraded tar, such as SCT. The process includes hydroprocessing a tar stream in the presence of a utility fluid, and is generally described in P.C.T. Patent Application Publication No. WO 2018/111577. For example, SATC can include hydroprocessing one or SCT streams, including those that have been subjected to prior pretreatments, in the presence of a utility fluid, to produce a hydroprocessed tar having a lesser viscosity, improved blending characteristics, fewer heteroatom impurities, and a lesser content of solids and semi-solids (e.g., fewer particles) as compared to the SCT feed.

"Tar Heavies" ("TH") means a product of hydrocarbon pyrolysis, typically included in a pyrolysis tar such as steam cracker tar. The TH typically have an atmospheric boiling point>565° C., and contain >5.0 wt % of molecules having a plurality of aromatic cores based on the weight of the tar. The TH are typically solid at 25° C. and generally include the fraction of SCT that is not soluble in a 5:1 (vol:vol) ratio of n-pentane:SCT at 25° C. TH generally includes asphaltenes and other high molecular weight molecules.

"Particles" means a solid material or semi-solid material in particulate form and can be or include polymeric asphaltene particles, polymeric coke particles, pyrolytic coke particles, inorganic fines, other organic or inorganic particles, or any combination thereof. Particles present in tar typically have a specific gravity from about 1.04 to about 1.5.

"Pyrolytic coke" or "pyrolytic coke particles" means a material generated by pyrolysis of organic molecules present in steam cracker tar and/or quench oils. The pyrolytic coke is in solid or particle form. Pyrolytic coke particles found in tars such as SCT typically have specific gravity in the range of about 1.2 to about 1.3.

"Polymeric coke" or "polymeric coke particles" is another form of particulate typically found in tar such as SCT. The polymeric coke material or particles typically have a specific gravity of about 1.04 to about 1.1. It is believed to be formed by oligomerization or polymerization of olefinic molecules, and has been observed to seed foulant. The olefinic molecules can be present in steam cracker tar and/or quench oils. Foulant can be, e.g., in the form of aggregates of particles or pyrolytic coke, polymeric coke, and combinations thereof.

When a particulate content (whether by weight, volume, or number) of a flowable material, such as tar or upgraded tar, is compared with that of another flowable material, the comparison is made under substantially the same conditions, e.g., substantially the same temperature, pressure, etc. When samples of flowable materials are obtained from a process for comparison elsewhere, e.g., in a laboratory, the particulate content comparison can be carried out (i) under conditions which simulate the process conditions and/or (ii) under ambient conditions, e.g., a temperature of 25° C. and a pressure of 1 bar (absolute).

"Solubility blending number (S)" and "insolubility number (I)" are described in U.S. Pat. No. 5,871,634, incorporated herein by reference in its entirety, and determined using n-heptane as the so-called "nonpolar, nonsolvent" and chlorobenzene as the solvent. The S and I numbers are determined at a weight ratio of oil to test liquid mixture in the range from 1.0 to 5.0. Various such values are referred to herein. For example, "$I_{feed}$" refers to the insolubility number of the hydrocarbon feed; "$I_{LD}$" refers to the insolubility number of the lower density portion separated from the hydrocarbon feed; "$I_{RD}$" refers to the insolubility number of the higher density portion separated from the hydrocarbon feed; "$I_{treated}$" refers to the insolubility number of the treated portion obtained from the lower density portion; "$I_{product}$" refers to the insolubility number of the hydroprocessed product; "$S_{FO}$" refers to the solubility blending number of the fuel oil blend-stock; and "$S_{fluid}$" refers to the solubility blending number of the fluid or the fluid-enriched stream, as appropriate. In conventional notation, these I and S values are frequently identified as $I_N$ and $S_{BN}$.

The terms "higher density portion" and "lower density portion" are relative terms meaning that a higher density portion has a mass density ($\rho_2$) that is higher than the density of the lower density portion ($\rho_1$), e.g., $\rho_2 \geq 1.01*\rho_1$, such as $\rho_2 \geq 1.05*\rho_1$, or $\rho_2 \geq 1.10*\rho_1$. In some aspects, the higher density portion contains primarily solid components and the lower density portion contains primarily liquid phase components. The higher density component may also include liquid phase components that have segregated from the lower density portion. Likewise, the lower-density portion can contain solids or semi-solids (even in particulate form) that have a density similar to that of the tar feed's liquid hydrocarbon component.

The term "portion" generally refers to one or more components derived from the fluid-feed mixture.

Except for its use with respect to parts-per-million, the term "part" is used with respect to a designated process stream, generally indicating that less than the entire designated stream may be selected. Unless otherwise state in a particular context, the term ppm means ppm by weight (indicated as "wppm" or "ppmw").

Embodiments are based in part on the discovery that combining a hydrocarbon feed with a fluid and separating from the fluid-feed mixture certain higher density components may result in a feed having improved compatibility with typical fuel oil blend-stocks and/or improve catalytic hydroprocessing of the fluid feed mixtures.

The Hydrocarbon Feed

The hydrocarbon feed may contain one or more hydrocarbon feeds described above, particularly SCT, residual fractions, or combinations thereof. Generally, the hydrocarbon feed has an insolubility number, $I_{feed} \geq 20$, e.g., ≥30, ≥40, ≥50, ≥60, ≥70, ≥80, ≥90, ≥100, ≥110, ≥120, ≥130, ≥140, or ≥150. Additionally or alternatively, the insolubility number of the feed may be ≤150, e.g., ≤140, ≤130, ≤120≤110, ≤100, ≤90, ≤80, ≤70, ≤60, ≤50, ≤40, or ≤30. Ranges expressly disclosed include combinations of any of the above-enumerated values; e.g., about 20 to about 150. Particular hydrocarbon feeds, e.g., certain SCTs, have an insolubility number, $I_{feed}$, of about 90 to about 150, about 100 to about 150, about 110 to about 150, about 120 to about 150, or about 130 to about 150. For other hydrocarbon feeds, e.g., residual fractures, the $I_{feed}$ may be about 20 to about 90, about 30 to 80, or about 40 to about 70. In certain aspects, the hydrocarbon feed has a mass density≥0.93 g/mL, e.g., ≤0.94 g/mL, such as ≤0.95 g/mL, or ≤0.96 g/mL, e.g., in the range of 0.93 to 0.97 g/mL. Certain representative SCTs have a mass density in the range of from 1.05 g/mL to 1.25 g/mL, such as 1.1 g/mL to 1.2 g/mL.

In certain aspects, it is desirable to utilize as a feed an SCT having little or no olefin content, particularly in aspects where one or more components of the fluid-feed mixture, e.g., the lower density portion or a part thereof, is subjected to hydroprocessing after separation. It is observed that the rate of reactor pressure-drop increase across the hydroprocessing reactor is lessened when utilizing an SCT having a lesser olefin content, e.g., a lesser content of vinyl aromatics. For example, in certain aspects the amount of olefin in the SCT is ≤10 wt %, e.g., ≤5 wt %, such as ≤2 wt %, based on the weight of the SCT. More particularly, the amount of (i) vinyl aromatics in the SCT and/or (ii) aggregates in the SCT which incorporate vinyl aromatics is generally ≤5 wt %, e.g., ≤3 wt %, such as ≤2 wt %, based on the weight of the SCT.

Suitable hydrocarbon feeds include those having relatively high sulfur content, e.g., ≥0.1 wt %, based on the weight of the SCT, such as ≥1, or ≥2 wt %, or in the range of 0.5 wt % to 7 wt %. High sulfur content is not needed, and relatively low sulfur-content SCT can be used, e.g., SCT having a sulfur content <0.1 wt %, based on the weight of the SCT, e.g., ≤0.05 wt %, such as ≤0.01 wt %. Hydrocarbon feeds having (i) a lesser olefin content and/or (ii) a higher sulfur content, and methods for producing such feeds, are disclosed in U.S. Pat. No. 9,809,756, which is incorporated by reference herein in its entirety.

The Fluid-Feed Mixture

The hydrocarbon feed is combined by any suitable method with a fluid (typically one or more of the indicated utility fluids) to form a fluid-feed mixture. The fluid-feed mixture generally contains ≥5 wt % of the hydrocarbon feed, e.g., ≥10 wt %, ≥20 wt %, ≥30 wt %, ≥40 wt %, ≥50 wt %, ≥60 wt %, ≥70 wt %, ≥80 wt %, or ≥90 wt % hydrocarbon feed, based on the total weight of the fluid-feed mixture. Additionally or alternatively, the fluid-feed mixture may include ≤10 wt % hydrocarbon feed, e.g., ≤20 wt %, ≤30 wt %, ≤40 wt %, ≤50 wt %, or ≤60 wt %, of the hydrocarbon feed, based on the total weight of the fluid feed mixture. Ranges expressly disclosed include combinations of any of the above-enumerated values, e.g., about 5 wt % to about 95 wt %.

In addition to the hydrocarbon feed, the fluid-feed mixture typically contains ≥30 wt % fluid, e.g., ≥40 wt %, ≥50 wt %, ≥60 wt %, ≥70 wt %, ≥80 wt %, or ≥90 wt %, based on the total weight of the fluid-feed mixture. Additionally or alternatively, the fluid-feed mixture may include ≤40 wt % fluid, ≤50 wt %, ≤60 wt %, ≤70 wt %, ≤80 wt %, ≤90 wt %, or ≤95 wt % fluid, based on the total weight of the fluid feed mixture. Ranges expressly disclosed include combinations of any of the above-enumerated values, e.g., about 5 wt % to about 95 wt %.

In one or more embodiments, the hydrocarbon feed is blended, mixed, or otherwise combined with one or more of the indicated utility fluids or other fluids/solvents to produce the fluid-feed mixture. The fluid-feed mixture has a reduced viscosity relative to the hydrocarbon feed. The fluid-feed mixture typically contains (i) about 25 wt %, about 30 wt %, about 35 wt %, about 40 wt %, about 45 wt %, or about 50 wt % to (ii) about 55 wt %, about 60 wt %, about 65 wt %, about 70 wt %, about 75 wt %, about 80 wt %, about 85 wt %, or about 90 wt %, or more of the utility fluid, based on a combined weight of the hydrocarbon feed and the utility fluid. Expressly disclosed ranges include those having any starting point (i) to any end point (ii).

In other aspects, the fluid-feed mixture has a has a solubility blending number S of (i) less than 150, such as about 140 or less, about 130 or less, about 120 or less, as about 115 or less, about 110 or less, about 105 or less, about 100 or less, about 95 or less, or about 90 or less, or (ii) about 70 or more, about 80 or more, about 85 or more, about 90 or more, about 95 or more, about 100 or more, about 105 or more, about 110 or more, about 115 or more, about 120 or more, about 130 or more, about 140 or more, or about 150. Ranges expressly disclosed include combinations of any of the above-enumerated values.

Generally, the fluid includes one or more of the specified utility fluids as a processing aid during hydroprocessing of the fluid-feed mixture, e.g., during at least some SATC stages. The fluid may also contain a separation fluid as a processing aid for particle separation from the fluid-feed mixture during centrifuging. In certain aspects the utility fluid and the separation have substantially the same composition, e.g., where the same fluid serves as a processing aid for both the hydroprocessing and the centrifuging. In other aspects the utility fluid and separation fluid have different compositions. In particular aspects, the fluid contains ≥50 wt % of utility fluid, such as ≥65 wt %, e.g., ≥75 wt %, ≥80 wt %, ≥85 wt %, ≥90 wt %, or ≥95 wt % utility fluid, based on the total weight of the fluid in the fluid-feed mixture. Additionally or alternatively, the fluid may contain ≤100 wt % utility fluid, e.g., ≤95 wt %, ≤90 wt %, ≤85 wt %, ≤80 wt %, ≤75 wt %, or ≤70 wt % utility fluid, based on the total weight of the fluid in the fluid-feed mixture. Ranges expressly disclosed include combinations of any of the above-enumerated values. In aspects where a separation fluid is not used, it is typical for the feed to be ≥50 wt % of the balance of the fluid-feed mixture (the balance being the part of the fluid-feed mixture that is not utility fluid), e.g., ≥75 wt %, such as ≥90 wt %, or ≥95 wt %, or ≥99 wt %.

When a distinct separation fluid is used (namely, a separation fluid having a substantially different composition from that of the utility fluid) the separation fluid can be present in the fluid-feed mixture in an amount ≤35 wt %, e.g., ≤30 wt %, ≤25 wt %, ≤20 wt %, ≤15 wt %, ≤10 wt %, ≤5 wt %, ≤2.5 wt %, or ≤1.5 wt %, based on the total weight of fluid in the fluid-feed mixture. Additionally or alternatively, the separation fluid may be present in an amount ≥ to 0 wt %, e.g., ≥1.5 wt %, ≥2.5 wt %, ≥5 wt %, ≥10 wt %, ≥15 wt %, ≥20 wt %, ≥25 wt %, or ≥30 wt %, based on the total weight of the fluid in the fluid-feed mixture. Ranges expressly disclosed include combinations of any of the above-enumerated values. It is typical in these and other aspects for separation fluid (when used) and feed together to be ≥50 wt % of the balance of the fluid-feed mixture (the balance being the part of the fluid-feed mixture that is not utility fluid), e.g., ≥75 wt %, such as ≥90 wt %, or ≥95 wt %, or ≥99 wt %.

Particularly in aspects where fluid-feed mixture components are not subjected to subsequent hydroprocessing, the fluid-feed mixture may comprise ≥30 wt % of a separation fluid. The fluid can contain both utility fluid and separation fluid. Thus, in some aspects, the fluid may contain ≥50 wt % separation fluid, e.g., ≥60 wt %, ≥70 wt %, ≥80 wt %, ≥90 wt %, ≥95 wt %, ≥97.5 wt %, ≥99 wt %, or 100 wt % separation fluid, based on the total weight of the fluid-feed mixture. Additionally or alternatively, the fluid-feed mixture may include ≤99 wt % separation fluid, e.g., ≤97.5 wt %, ≤95 wt %, ≤90 wt %, ≤80 wt %, ≤70 wt %, or ≤60 wt % separation fluid, based on the total weight of the fluid-feed mixture. Ranges expressly disclosed include combinations of any of the above-enumerated values.

Generally, but not necessarily, the dynamic viscosity of the fluid-feed mixture is less than that of the hydrocarbon feed. In particular aspects, the dynamic viscosity of the fluid-feed mixture may be ≥0.5 cPoise, e.g., ≥1 cPoise, ≥2.5 cPoise, ≥5 cPoise, ≥7.5 cPoise, at a temperature of about 50° C. to about 250° C., such as about 100° C. Additionally or alternatively, the dynamic viscosity of the fluid-feed mixture may be ≤10 cPoise, e.g., ≤7.5 cPoise, ≤5 cPoise, ≤2.5 cPoise, ≤1 cPoise, ≤0.75 cPoise, at a temperature of about 50° C. to about 250° C., such as about 100° C. Ranges expressly disclosed include combinations of any of the above-enumerated values.

The Utility Fluid

Conventional utility fluids can be used, such as those used as a process aid for hydroprocessing tar such as SCT, but the invention is not limited thereto. Suitable utility fluids include those disclosed in U.S. Provisional Patent Application No. 62/716,754; U.S. Pat. Nos. 9,090,836; 9,637,694; 9,777,227; and 9,809,756; and International Patent Application Publication No. WO 2018/111574, these being incorporated by reference herein in their entireties. The utility fluid typically comprises ≥40 wt %, of at least one aromatic or non-aromatic ring-containing compound, e.g., ≥45 wt %, ≥50 wt %, ≥55 wt %, or ≥60 wt %, based on the weight of the utility fluid. Particular utility fluids contain ≥40 wt %, ≥45 wt %, ≥50 wt %, ≥55 wt %, or ≥60 wt % of at least one multi-ring compound, based on the weight of the utility fluid. The compounds contain a majority of carbon and hydrogen atoms, but can also contain a variety of substituents and/or heteroatoms.

In certain aspects, the utility fluid contains aromatics, e.g., ≥70 wt % aromatics, based on the weight of the utility fluid, such as ≥80 wt %, or ≥90 wt %. Typically, the utility fluid contains ≤10 wt % of paraffin, based on the weight of the utility fluid. For example, the utility fluid can contain ≥95 wt % of aromatics, ≤5 wt % of paraffin. Optionally, the utility fluid has a final boiling point ≤750° C. (1,400° F.), e.g., ≤570° C. (1,050° F.), such as ≤430° C. (806° F.). Such utility fluids can contain ≥25 wt % of 1-ring and 2-ring aromatics (e.g., those aromatics having one or two rings and at least one aromatic core), based on the weight of the utility fluid. Utility fluids having a relatively low final boiling point can be used, e.g., a utility fluid having a final boiling point ≤400° C. (750° F.). The utility fluid can have an 10% (weight basis) total boiling point ≥120° C., e.g., ≥140° C., such as ≥150° C. and/or a 90% total boiling point ≤430° C., e.g., ≤400° C. Suitable utility fluids include those having a true boiling point distribution generally in the range from 175° C. (350° F.) to about 400° C. (750° F.). A true boiling point distribution can be determined, e.g., by conventional methods such as the method of A.S.T.M. D7500, which can be extended by extrapolation when the true boiling point distribution has a final boiling point that is outside the range encompassed by the A.S.T.M. method. In certain aspects, the utility fluid has a mass density ≤0.91 g/mL, e.g., ≤0.90 g/mL, such as ≤0.89 g/mL, or ≤0.88 g/mL, e.g., in the range of 0.87 g/mL to 0.90 g/mL.

The utility fluid typically contains aromatics, e.g., ≥95.0 wt % aromatics, such as ≥99.0 wt %. For example, the utility fluid can contain ≥75 wt % based on the weight of the utility fluid of one or more of benzene, ethylbenzene, trimethylbenzene, xylenes, toluene, naphthalenes, alkylnaphthalenes (e.g., methylnaphtalenes), tetralins, or alkyltetralins (e.g., methyltetralins), e.g., ≥90 wt %, or ≥95 wt %, or ≥99.0 wt %, such as ≥99.9 wt %. It is generally desirable for the utility fluid to be substantially free of molecules having alkenyl functionality, particularly in aspects utilizing a hydroprocessing catalyst having a tendency for coke (e.g., pyrolytic and/or polymeric particles) formation in the presence of such molecules. In certain aspects, the utility fluid contains ≤10.0 wt % of ring compounds having $C_1$-$C_6$ sidechains with alkenyl functionality, based on the weight of the utility fluid.

In some examples, the utility fluid can include ≥90 wt % of a single-ring aromatic, including those having one or more hydrocarbon substituents, such as from 1 to 3 or 1 to 2 hydrocarbon substituents. Illustrative hydrocarbon substituents or hydrocarbon groups can be or include, but are not limited to, $C_1$-$C_6$ alkyls, where the hydrocarbon groups can be branched or linear and the hydrocarbon groups can be the same or different.

In some examples, the utility fluid can be substantially free of molecules having terminal unsaturates, for example, vinyl aromatics. As used herein, the term "substantially free" means that the utility fluid includes 10 wt % or less, e.g., 5 wt % or less or 1 wt. % or less, of terminal unsaturates, based on the weight of the utility fluid. The utility fluid can include ≥50 wt % of molecules having at least one aromatic core, e.g., ≥60 wt % or ≥70 wt %, based on the weight of the utility fluid. In some examples, the utility fluid can include ≥60 wt % of molecules having at least one aromatic core and 1 wt % or less of terminal unsaturates, e.g., vinyl aromatics, based on the weight of the utility fluid.

Where hydroprocessing is envisioned, the utility fluid typically contains sufficient amount of molecules having one or more aromatic cores as a processing aid, e.g., to effectively increase run length of the tar hydroprocessing process. For example, the utility fluid can contain ≥50.0 wt % of molecules having at least one aromatic core (e.g., ≥60.0 wt %, such as ≥70 wt %) based on the total weight of the utility fluid. In an aspect, the utility fluid contains (i) ≥60.0 wt % of molecule having at least one aromatic core and (ii) ≤1.0 wt % of vinyl aromatics, the weight percent being based on the weight of the utility fluid.

The utility fluid can be one having a high solvency, as measured by solubility blending number ("$S_{Fluid}$"). For example, the utility fluid can have a $S_{Fluid}$≥90, e.g., ≥100, ≥110, ≥120, ≥150, ≥175, or ≥200. Additionally or alternatively, $S_{Fluid}$ can be ≤200, e.g., ≤175, ≤150, ≤125, ≤110, or ≤100. Ranges expressly disclosed include combinations of any of the above-enumerated values.

Additionally or alternatively, the utility fluid may be characterized by a dynamic viscosity of that is typically less than that of the fluid-feed mixture. In particular aspects, the dynamic viscosity of the fluid-feed mixture may be ≥0.1 cPoise, e.g., ≥0.5 cPoise, ≥1 cPoise, ≥2.5 cPoise or, ≥4 cPoise, at a temperature of about 50° C. to about 250° C., such as about 100° C. Additionally or alternatively, the dynamic viscosity of the fluid-feed mixture may be ≤5 cPoise, e.g., ≤4 cPoise, ≤2.5 cPoise, ≤1 cPoise, ≤0.5 cPoise, or ≤0.25 cPoise, at a temperature of about 50° C. to about 250° C., such as about 100° C. Ranges expressly disclosed include combinations of any of the above-enumerated values. In some aspects, the dynamic viscosity of the utility fluid is adjusted so that when combined with the hydrocarbon feed to produce the fluid-feed mixture, particles having a size larger than 25 μm settle out of the fluid-feed mixture to provide the solids-enriched portion (the extract) and particulate-depleted portions (the raffinate) described herein, more particularly to adjust the viscosity to also enable the amount of solids removal and throughput of the particle-depleted portion from the process.

The Separation Fluid

The separation fluid can be any hydrocarbon liquid having a mass density that is less than that of the feed, e.g., ≤1% that of the feed, such as ≤5%, or ≤10%. The separation fluid is typically a non-polar hydrocarbon, or mixture thereof. In particular aspects, the separation fluid may be a paraffinic hydrocarbon or a mixture or paraffinic hydrocarbons. Particular paraffinic fluids include $C_5$ to $C_{20}$ hydrocarbons and mixtures thereof, particularly $C_5$ to $C_{10}$ hydrocarbons, e.g., hexane, heptane, and octane. Such fluids may be particularly useful when subsequent hydroprocessing is not desired. In certain aspects, the separation fluid has a mass density ≤0.91 g/mL, e.g., ≤0.90 g/mL, such as ≤0.89 g/mL, or ≤0.88 g/mL, e.g., in the range of 0.87 g/mL to 0.90 g/mL.

Separating the Higher Density and Lower Density Portions

The fluid-feed mixture may be separated by any means suitable for forming the higher density and lower density portions. In particular aspects, the fluid-feed mixture may be separated by sedimentation, filtration, extraction, or any combination thereof. Conventional separations technology can be utilized, but embodiments are not limited thereto. For example, the lower density portion may be separated by decantation, filtration and/or boiling point separation (e.g., one or more distillation towers, splitters, flash drums, or any combination thereof). The higher density portion may be separated in a similar manner, e.g., by removing the higher density portion from the separation stage as a bottoms portion. In particular aspects, the fluid-feed mixture is separated by exposing the fluid-feed mixture to a centrifugal force, e.g., by employing one or more centrifuges in the separation stage. In some embodiments, methods employ centrifuge separations in the separation stage will now be described in more detail. Embodiments are not limited to these aspects, as well as this description is not to be interpreted as foreclosing the use of additional and/or alternative separations technologies, such as those that do not involve exposing the fluid-feed mixture to a centrifugal force.

Inducing the Centrifugal Force

In particular aspects, the fluid-feed mixture containing the cracked tar, the particles (e.g., pyrolytic coke, polymeric coke, and/or inorganics), and the utility fluid is provided to at least one centrifuge and exposed to a centrifugal force sufficient to form at least a higher density portion and a lower density portion. Typically, the fluid-feed mixture in the centrifuge exhibits a substantially uniform circular motion as a result of an applied central force. Depending on reference-frame choice, the central force can be referred to as a centrifugal force (in the reference-frame of the fluid-feed mixture) or a centripetal force (in the reference frame of the centrifuge). The particulars of the centrifuge design and operation are not critical. The process may be performed in a batch, semi-batch, or continuous manner. Typically, a plurality of centrifuges is used. Although the centrifuges are typically configured in series (one after the other), configurations having centrifuges arranged in parallel and/or series-parallel are within the scope of the invention.

The material undergoing the separation, e.g., the fluid-feed mixture and/or a raffinate derived from the fluid-feed mixture in a prior separation) is at an elevated temperature during the separation, e.g., while the centrifugal force is applied, such as during centrifuging. In some aspects, the fluid-feed mixture comprises tar, such as SCT, which during separation of the higher density portion and lower density portion is at a temperature of ≥ about 60° C., or ≥ about 65° C., or ≥ about 70° C. For example, the fluid-feed mixture during centrifuging can be at a temperature of (i) about 60° C., about 65° C., or ≥ about 70° C., to (ii) about 75° C., about 80° C., about 90° C., about 100° C., about 110° C., about 120° C., about 130° C., about 140° C., about 150° C., about 160° C., about 170° C., about 180° C., about 180° C., about 200° C., about 210° C., about 220° C., or greater. For example, while centrifuging, the fluid-feed mixture can be at a temperature of about 60° C. to about 220° C., about 60° C. to about 200° C., about 60° C. to about 200° C., about 80° C. to about 200° C., about 100° C. to about 200° C., about 60° C. to about 180° C., about 70° C. to about 180° C., about 80° C. to about 180° C., about 90° C. to about 180° C., about 100° C. to about 180° C., about 60° C. to about 160° C., about 80° C. to about 160° C., about 100° C. to about 160° C., about 60° C. to about 150° C., about 80° C. to about 150° C., or about 100° C. to about 150° C. Should material undergoing the separation (e.g., the fluid-feed mixture and/or a raffinate derived from the fluid-feed mixture in a prior separation) be at a temperature <60° C., the material can be heated to achieve a temperature in the indicated temperature range, e.g., by heating before and/or during the separation, such as during the centrifuging. For example, the fluid-feed mixture during or before centrifuging can be heated to a temperature during centrifuging that is greater than 60° C. to about 220° C., greater than 60° C. to about 200° C., greater than 60° C. to about 200° C., greater than 65° C. to about 200° C., greater than 70° C. to about 200° C., greater than 80° C. to about 200° C., greater than 90° C. to about 200° C., greater than 100° C. to about 200° C., greater than 60° C. to about 180° C., greater than 70° C. to about 180° C., greater than 70° C. to about 160° C., greater than 80° C. to about 160° C., greater than 900° C. to about 160° C., greater than 100° C. to about 160° C., greater than 60° C. to about 150° C., greater than 70° C. to about 150° C., greater than 80° C. to about 150° C., greater than 90° C. to about 150° C., or greater than 100° C. to about 150° C.

Centrifuging the fluid-feed mixture typically results in separating from the fluid-feed mixture at least (i) an extract comprising (or consisting essentially of, or consisting of) a higher density portion of the fluid-feed mixture and (ii) a raffinate comprising (or consisting essentially of, or consisting of) a lower density portion. In other words, exposing the fluid-feed mixture to the centrifugal force results in the removal of at least the higher density portion (the extract) from the fluid-feed mixture. When the process is operated continuously or semi-continuously, at least two streams can be conducted away from the centrifuging: one stream containing the extract and another stream containing the raffinate. Conventional centrifuges can be used, including those capable of operating continuously, but the invention is not limited thereto.

The centrifugal force may be applied to the fluid-feed mixture for any amount of time. In a continuous centrifuge process, the fluid-feed mixture is continuously fed into the centrifuge system. Any suitable separator or centrifuge may be used, including industrial-scale, continuously fed centrifuges commercially available from Alfa Laval Corporate AB. The amount of time applied to the fluid-feed mixture is proportional to the flowrate of the fluid-feed mixture being introduced and/or pass through the centrifuge system. The centrifugal force may be applied at any convenient speed capable of separating the higher density portion and the lower density portion from the fluid-feed mixture. For example, a sufficient force will be provided by a centrifuge operating at about 1,000 rpm to about 10,000 rpm, about 2,000 rpm to about 7,500 rpm, or about 3,000 rpm to about 5,000 rpm.

In certain aspects the centrifuging is carried out in a batch process, e.g., with the centrifugal force being applied for ≥1 minute, e.g., ≥5 minutes, ≥10 minutes, ≥30 minutes, ≥60 minutes or, ≥120 minutes. Additionally or alternatively, in these aspects, the centrifugal force may be applied for ≤120 minutes, ≤60 minutes, ≤30 minutes, ≤10 minutes, or ≤5 minutes. Ranges expressly disclosed include combinations of any of the above-enumerated values. In other aspects, the centrifuging is carried out continuously, e.g., by continuously conducting a flow of fluid-feed mixture to one or more centrifuges, and continuously conducting away at least the higher density portion via a first outlet conduit and the lower density portion via a second outlet conduit. In the continuous configuration, fluid-feed flow rate can be regulated to achieve a residence time in the centrifuge(s) that is congruent with the centrifuge times specified for batch processing.

Typically centrifuging is sufficient to segregate ≥75 wt %, ≥80 wt %, ≥90 wt %, ≥92 wt %, ≥95 wt %, ≥96 wt %, ≥97 wt %, ≥98 wt %, ≥99 wt % of solids having size ≥2 μm, e.g., ≥10 μm, ≥20 μm, or ≥25 μm, into the higher density portion (e.g., the extract), the wt % being based on the total weight of solids in the higher density and lower density portions. Where subsequent hydroprocessing of the raffinate is envisioned, the higher density portion contains ≥75 wt %, ≥85 wt %, ≥90 wt %, ≥95 wt %, ≥98 wt %, particularly ≥99 wt %, of solids having a size of ≥25 μm, particularly, ≥20 μm, ≥10 μm, or ≥2 μm. In one or more examples, the lower density portion contains at least 75% fewer particles (by weight) than the fluid-feed mixture, such as at least 80%, at least 85%, at least 90%, at least 92%, at least 95%, at least 98%, of at least 99%. In other aspects, e.g., where the lower density portion (e.g., the raffinate) is not subjected to hydroprocessing, filtration should be sufficient to segregate at least 80 wt % of particles in the fluid-feed mixture into the higher density portion.

While the description focuses on a higher density portion and a lower density portion, other embodiments envision that the components of the fluid-feed mixture may be more discretely segregated and extracted, e.g., very light components segregating to the top of the mixture, a portion that contains primarily the fluid therebelow, an upgraded tar portion, tar heavies, or solids at the bottom of the centrifuge chamber. Each of these portions, or combinations thereof, may be selectively removed from the mixture as one or more raffinates. Typically, the higher density portion discussed below is selected to extract undesired tar heavies and solid components, while the lower density portion includes the remainder.

Figure 3:
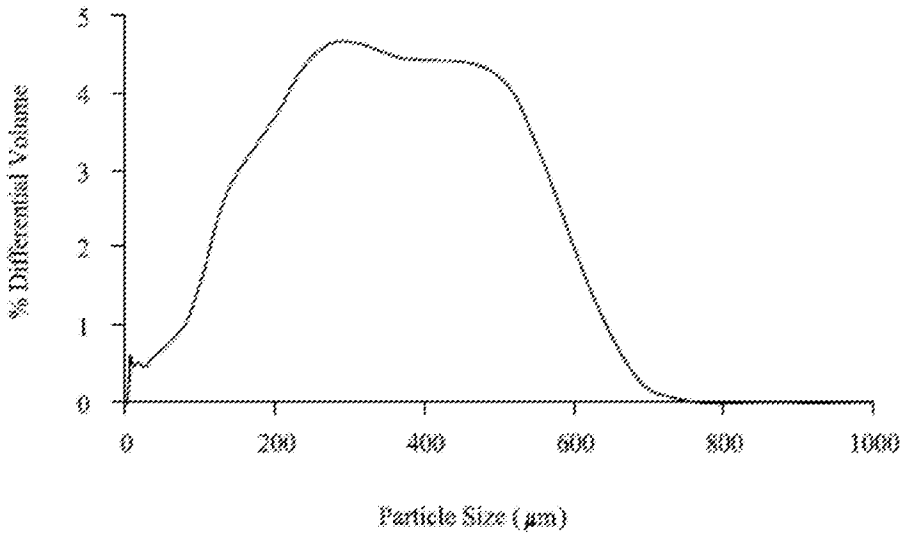
FIG. 3 depicts a particle size distribution chart that provides a comparison of the differential volume percent versus particle sizes for the particles contained in a hydrocarbon or tar stream, according to one or more embodiments.

FIG. 3 depicts a particle size distribution chart that provides a comparison of the differential volume percent versus particle sizes for particles of solids and semi-solids present in a representative SCT at a temperature of 25° C. and a pressure of about 1 bar. The differential volume is greater than 1% for particles having a particle size of about 100 μm to about 700 μm, greater than 3% for particles having a particle size of about 200 μm to about 600 μm, and greater than 4% for particles having a particle size of about 300 μm to about 500 μm. The particles can be or include pyrolytic coke particles, polymeric asphaltene particles, polymeric coke particles, inorganic fines, and/or other solids), other types of solids or semi-solids, or any combination thereof. In one or more embodiments, one or more of the specified hydrocarbon feeds (e.g., one or more of the specified SCTs) and/or the fluid-feed mixture contains greater than 500 ppmw of particles having a size of greater than 25 μm, based on the weight of the fluid-feed mixture. For example, these can contain ≥ about 550 ppmw, ≥ about 600 ppmw, ≥ about 750 ppmw, ≥ about 900 ppmw, ≥ about 1,000 ppmw, or more of particles having a size of greater than 25 μm.

The Polymeric Coke Particles

Polymeric coke particles are different from typical coke solids generated by the steam cracker process, in that the polymeric coke particles are initially generated by oligomerization and/or polymerization of olefinic molecules present in both steam cracker tar and quench oils used to achieve separation in the primary fractionator. Polymeric coke particles and aggregates that include polymeric coke, can agglomerate, e.g., with additional polymer coke and other particles, to form a foulant. Since the foulant is capable of adhering to equipment internals, e.g., to piping, reactors, separators, heat transfer stages, etc., it can interfere with processing the hydrocarbon feed, fluid-feed mixture, etc.

The specific gravity of the polymeric coke particles can be about 1.04, about 1.05, about 1.06, or about 1.07 to about 1.08, about 1.09, about 1.10, or about 1.11. For example, the specific gravity of the polymeric coke particles can be about 1.04 to about 1.1, about 1.06 to about 1.1, about 1.08 to about 1.1, about 1.04 to about 1.10, about 1.04 to about 1.08, or about 1.04 to about 1.06. The specific gravity of other particles typically found in the hydrocarbon feed (pyrolytic coke particles, inorganic particles, metal, etc., is generally greater than 1.1, such as about 1.2 to about 1.3, or greater.

The polymeric coke particles contained in the fluid-feed mixture typically have a particle size distribution that includes particles having sizes from about 1 μm to about 50 μm. However, lesser amounts of particles having sizes which are less than 1 μm, as well as greater than 50 μm are also present in the fluid-feed mixture. In one or more embodiments, the polymeric coke particles in the fluid-feed mixture have a particle size distribution of greater than 1 vol % for the polymeric coke particles having a size of greater than 25 μm.

The higher density portion and lower density portion will now be described in more detail. This invention is not limited to these, and this description is not meant to foreclose separating other high or low density portions, or other raffinates/extracts (including pluralities thereof) within the broader scope of the invention.

The Higher Density Portion

Regardless of how the higher density portion and lower density portion are separated, the higher density portion, particularly the liquid-phase part thereof, may have an insolubility number, $I_{HD}$, ≥20, ≥40, ≥70, ≥90, ≥100, ≥110, ≥120, ≥130, ≥140, or ≥150. Additionally or alternatively, $I_{HD}$, may be ≤40, ≤70, ≤90, ≤100, ≤110, ≤120, ≤130, ≤140, or ≤150. Ranges expressly disclosed include combinations of any of the above-enumerated values.

Additionally or alternatively, the higher density portion can contain asphaltenes and/or tar heavies. In particular aspects, the higher density portion, particularly the liquid portion thereof, contains ≥50 wt % asphaltenes, e.g., ≥60 wt %, ≥75 wt %, based on the total weight of the higher density portion. The higher density portion may include ≤10 wt %, e.g., ≤7.5 wt %, ≤5 wt %, ≤2.5 wt %, ≤2 wt %, ≤1.5 wt %, or ≤1 wt %, of the total asphaltene content of the hydrocarbon feed. The higher density portion may include ≥1 wt %, e.g., ≥1.5 wt %, ≥2 wt %, ≥2.5 wt %, ≥5 wt %, or ≥7.5 wt %, of the total asphaltene content of the hydrocarbon feed. Ranges expressly disclosed include combinations of any of the above-enumerated values. It has been surprisingly found that transferring (e.g., by centrifuging) even small amounts of asphaltenes from the fluid-feed mixture to the higher density portion has a surprisingly favorable impact on the insolubility number of the lower density portion. While not wishing to be bound by any theory or model, it is believed that the presence of relatively high-density asphaltenes in the hydrocarbon feed have a much greater impact on insolubility number than do lower-density asphaltenes. Thus, a relatively large amount of problematic molecules can be separated, leaving in the lower density portion molecules that will contribute to the over-all yield of the process, e.g., by providing a relatively greater amount of hydrocarbon for upgrading (e.g., by hydroprocessing) as compared to conventional separation methods.

The benefits of the processes may be obtained even when the higher density portion contains a relatively small fraction of the hydrocarbon feed. The higher density portion may contain ≤10 wt %, e.g., ≤7.5 wt %, ≤5 wt %, ≤2.5 wt %, ≤2 wt %, ≤1.5 wt %, or ≤1 wt % of the total weight of the hydrocarbon feed present in the fluid-feed mixture. Ranges expressly disclosed include combinations of any of the above-enumerated values. The removal of a relatively small weight fraction may surprisingly be accompanied by a relatively large improvement in the insolubility number of the lower density portion. The particulates present in the extract optionally have a mass density≥1.05 g/mL, e.g., ≥1.1 g/mL, such as ≥1.2 g/mL, or ≥1.3 g/mL.

The Lower Density Portion

The lower density portion (e.g., a raffinate) is conducted away from the first separation stage for one or more of storage, blending with other hydrocarbons, or further processing. The lower density portion generally has a desirable insolubility number, e.g., an insolubility number that is less than that of the hydrocarbon feed and/or less than that of the higher density portion. Typically, the insolubility number of the lower density portion ($I_{LD}$) is ≥20, e.g., ≥30, ≥40, ≥50, ≥60, ≥70, ≥80, ≥90, ≥100, ≥110, ≥120, ≥130, ≥140, or ≥150. Additionally or alternatively, the $I_{LD}$ may be ≤150, e.g., ≤140, ≤130, ≤120 ≤110, ≤100, ≤90, ≤80, ≤70, ≤60, ≤50, ≤40, or ≤30. Ranges expressly disclosed include combinations of any of the above-enumerated values. Those skilled in the art will appreciate that hydrocarbon separations technology is imperfect, and, consequently, a small amount of solids may be present in the lower density portion, e.g., an amount of solids that is ≤0.1 times the amount of solids in the fluid-feed mixture, such as ≤0.01 times. In aspects where at least part of the lower density portion is hydroprocessed, solids-removal means (e.g., one or more filters) are typically employed between the first separation stage and the hydroprocessing stage.

The ratio of the insolubility number of the lower density portion, $I_{LD}$, to the insolubility number of the hydrocarbon feed, $I_{feed}$, is ≤0.95, e.g., ≤0.90, ≤0.85, ≤0.80, ≤0.75, ≤0.70, ≤0.65, ≤0.60, ≤0.55, ≤0.50, ≤0.40, ≤0.30, ≤0.20, or ≤0.10. Additionally or alternatively, the ratio of $I_{LD}$ to $I_{feed}$ may be ≥0.10, e.g., ≥0.20, ≥0.30, ≥0.40, ≥0.50, ≥0.55, ≥0.60, ≥0.65, ≥0.70, ≥0.75, ≥0.80, ≥0.85, or ≥0.90. Ranges expressly disclosed include combinations of any of the above-enumerated values.

The first separation stage is configured to transfer to the higher density portion a major amount, or substantially all, or all of the fluid-feed mixture's particles having a size of greater than 10 μm, greater than 12 μm, greater than 15 μm, greater than 18 μm, greater than 20 μm, greater than 22 μm, or greater than 25 μm. In one or more embodiments, the lower density portion contains about 500 ppmw or less of particles having a size of greater than 25 μm, based on the weight of the lower density portion. For example, the lower density portion contains ≤ about 450 ppmw, ≤ about 400 ppmw, ≤ about 300 ppmw, ≤ about 250 ppmw, ≤ about 200 ppmw, ≤ about 150 ppmw, ≤ about 100 ppmw, ≤ about 80 ppmw, or ≤ about 50 ppmw, of particles having a size of greater than 25 μm. The lower density portion can be "substantially free" of particles having a size greater than 25 μm, meaning that the lower density portion comprises ≤ 10 ppmw of particles having a size greater than 25 μm.

The Treated Portion

Typically it is desired to recover the fluid, e.g., for recycle and re-use in the process. Fluid can be recovered as a second raffinate from the first separation stage, or alternatively/additionally can be separated from the first raffinate (e.g., the lower density portion) in a second separation stage located downstream of the first separation stage. For example, the fluid may optionally be separated from the lower density portion to form a treated portion of the hydrocarbon. Any suitable separation means may be used. For example, the fluid may be separated by fractionation in one or more additional separation stages, such as in one or more distillation towers, or by vapor-liquid separation, such as by one or more vapor-liquid separators. Alternatively, the fluid may be separated via one or more flash drums, splitters, fractionation towers, membranes, absorbents, or any combination thereof, though the method is not limited thereto. The recovered fluid recovered for further use, e.g., for recycle to the process.

The treated portion may have an insolubility number, $I_{treated}$, ≥20, e.g., ≥30 ≥40, ≥50, ≥60, ≥70, ≥80, ≥90, ≥100, ≥110, ≥120, ≥130, ≥140, ≥150. Additionally or alternatively, the insolubility number of the treated portion may be ≤150, e.g., ≤140, ≤130, ≤120, ≤110, ≤100, ≤90, ≤80, ≤70, ≤60, ≤50, ≤40, or ≤30. Ranges expressly disclosed include combinations of any of the above-enumerated values.

The ratio of the insolubility number of the treated portion, $I_{treated}$, to the insolubility number of the hydrocarbon feed, $I_{feed}$, is typically ≤0.95, e.g., ≤0.90, ≤0.85, ≤0.80, ≤0.75, ≤0.70, ≤0.65, ≤0.60, ≤0.55, ≤0.50, ≤0.40, ≤0.30, ≤0.20, or ≤0.10. Additionally or alternatively, the $I_{treated}$:$I_{feed}$ ratio may be ≥0.10, e.g., ≥0.20, ≥0.30, ≥0.40, ≥0.50, ≥0.55, ≥0.60, ≥0.65, ≥0.70, ≥0.75, ≥0.80, ≥0.85, or ≥0.90. Ranges expressly disclosed include combinations of any of the above-enumerated value.

Hydroprocessing

Additionally or alternatively, at least part of (i) the lower density portion and/or (ii) the treated portion may be provided to a hydroprocessing unit, typically as a processing aid, e.g., to effectively increase run-length of the hydroprocessing unit. Typically, the fluid is not separated from the lower density portion prior to hydroprocessing. In other words, except for solids-removal, at least part of the raffinate can be conducted from a first separation stage to the hydroprocessor without any intervening separation. The amount of fluid in the raffinate during hydroprocessing may be in the range from about 5.0 wt % to about 80.0 wt % fluid, based on the weight of the raffinate, e.g., about 10.0 wt % to about 80.0 wt %, such as about 10.0 wt % to about 60.0 wt %.

Hydroprocessing of the lower density portion can occur in one or more hydroprocessing stages, the stages containing one or more hydroprocessing vessels or zones. Vessels and/or zones within the hydroprocessing stage in which catalytic hydroprocessing activity occurs generally include at least one hydroprocessing catalyst. The catalysts can be mixed or stacked, such as when the catalyst is in the form of one or more fixed beds in a vessel or hydroprocessing zone.

Conventional hydroprocessing catalyst can be utilized for hydroprocessing the lower density portion, such as those specified for use in residual fracturing and/or heavy oil hydroprocessing, but the method is not limited thereto. Suitable hydroprocessing stages, catalysts, process conditions, and pretreatments include those disclosed in P.C.T. Patent Application Publication Nos. WO2018/111574, WO2018/111576, and WO2018/111577, which are incorporated by reference herein in their entireties.

Hydroprocessing the lower density portion (e.g., the raffinate) leads to improved catalyst life, e.g., allowing the hydroprocessing stage to operate for at least 3 months, or at least 6 months, or at least 1 year without replacement of the catalyst in the hydroprocessing or contacting zone. Since catalyst life is generally lengthened when heavy hydrocarbon is hydroprocessed in the presence of utility fluid, e.g., >10 times longer than would be the case if no utility fluid were utilized, it is generally desirable to recover utility fluid (e.g., for recycle and reuse) from the hydroprocessor effluent instead of from the hydroprocessor feed.

The amount of coking in the hydroprocessing or contacting zone is relatively small and run lengths are relatively long as indicated by relatively a small increase in reactor pressure drop over its start-of-run ("SOR") value, as calculated by ([Observed pressure drop−Pressure $drop_{SOR}$]/Pressure $drop_{SOR}$)*100%. The increase in pressure drop may be ≤10%, ≤5%, ≤2.5%, or ≤1%. Additionally or alternatively, the hydroprocessing reactor's increase in pressure drop compared to its SOR value may be ≤30 psi (2 bar), e.g., ≤25 psi (1.7 bar), ≤20 psi (1.3 bar), ≤15 psi (1.0 bar), ≤10 psi (0.7 bar), or ≤5 psi (0.3 bar), ≥1 psi (0.07 bar), ≥5 psi (0.3 bar), ≥10 psi (0.7 bar), ≥15 psi (1.0 bar), ≥20 psi (1.3 bar), or ≥25 psi (1.7 bar). Ranges of the pressure drop expressly disclosed include all combinations of these values, e.g., about 1 psi to about 30 psi (0.07 bar to 2 bar), about 1 psi to about 25 psi (0.07 bar to 1.7 bar), about 1 psi to about 20 psi (0.07 bar to 1.3 bar), about 1 psi to about 15 psi (0.07 bar to 1.0 bar), about 1 psi to about 10 psi (0.07 bar to 0.7 bar), or about 1 psi to about 5 psi (0.07 bar to 0.3 bar). The pressure drop may be determined between any two convenient times, $t_1$ and $t_2$. $t_1$ is typically the time associated with the SOR value. Time $t_2$ may be any arbitrary time thereafter. Thus, the observed pressure drop may be determined over a period, $t_2-t_1$, ≥30 days ≥50 days, ≥75 days, ≥100 days, ≥125 days, ≥150 days, ≥175 days, ≥200 days, ≥250 days, ≥300 days, ≥350 days, ≥400 days, ≥450 days, ≥500 days, ≥550 days, ≥600 days, ≥650 days, or ≥700 days or longer.

The hydroprocessing is carried out in the presence of hydrogen, e.g., by (i) combining molecular hydrogen with the tar stream and/or fluid upstream of the hydroprocessing and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains ≥ about 50 vol % of molecular hydrogen, e.g., ≥ about 75 vol %, based on the total volume of treat gas conducted to the hydroprocessing stage.

Optionally, the amount of molecular hydrogen supplied to the hydroprocessing stage is in the range from about 300 SCF/B (standard cubic feet per barrel) (53 standard cubic meter of treat gas per cubic meter of feed, "S $m^3/m^3$") to 5,000 SCF/B (890 S $m^3/m^3$), in which B refers to barrel of feed to the hydroprocessing stage. For example, the molecular hydrogen can be provided in a range from 1,000 SCF/B (178 S $m^3/m^3$) to 3,000 SCF/B (534 S $m^3/m^3$). Hydroprocessing the lower density portion, molecular hydrogen, and a catalytically effective amount of the specified hydroprocessing catalyst under catalytic hydroprocessing conditions produce a hydroprocessed effluent. An example of suitable catalytic hydroprocessing conditions will now be described in more detail. Embodiments are not limited to these conditions, and this description is not meant to foreclose other hydroprocessing conditions within the broader scope of the embodiments.

The hydroprocessing is generally carried out under hydroconversion conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing of the specified tar stream. The hydroprocessing reaction can be carried out in at least one vessel or zone that is located, e.g., within a hydroprocessing stage downstream of the pyrolysis stage and separation stage. The lower density portion including the fluid generally contacts the hydroprocessing catalyst in the vessel or zone, in the presence of molecular hydrogen. Catalytic hydroprocessing conditions can include, e.g., exposing the feed to the hydroprocessing reactor to temperature in the range from 50° C. to 500° C. or from 200° C. to 450° C. or from 220° C. to 430° C. or from 350° C. to 420° C. proximate to the molecular hydrogen and hydroprocessing catalyst. For example, a temperature in the range from 300° C. to 500° C., or 350° C. to 430° C., or 360° C. to 420° C. can be utilized. Liquid hourly space velocity (LHSV) of the lower density portion will generally range from 0.1 $h^{-1}$ to 30 $h^{-1}$, or 0.4 $h^{-1}$ to 25 $h^{-1}$, or 0.5 $h^{-1}$ to 20 $h^{-1}$. In some aspects, LHSV is at least 5 $h^{-1}$, or at least 10 $h^{-1}$, or at least 15 $h^{-1}$. Molecular hydrogen partial pressure during the hydroprocessing is generally in the range from 0.1 MPa to 8 MPa, or 1 MPa to 7 MPa, or 2 MPa to 6 MPa, or 3 MPa to 5 MPa. In some aspects, the partial pressure of molecular hydrogen is ≤7 MPa, or ≤6 MPa, or ≤5 MPa, or ≤4 MPa, or ≤3 MPa, or ≤2.5 MPa, or ≤2 MPa. The hydroprocessing conditions can include, e.g., one or more of a temperature in the range of 300° C. to 500° C., a pressure in the range of 15 bar (absolute) to 135 bar, or 20 bar to 120 bar, or 20 bar to 100 bar, a space velocity (LHSV) in the range of 0.1 to 5, and a molecular hydrogen consumption rate of about 53 S $m^3/m^3$ to about 445 S $m^3/m^3$ (300 SCF/B to 2,500 SCF/B, where the denominator represents barrels of the tar stream, e.g., barrels of SCT). In one or more aspects, the hydroprocessing conditions include one or more of a temperature in the range of 380° C. to 430° C., a pressure in the range of 21 bar (absolute) to 81 bar (absolute), a space velocity in the range of 0.2 to 1, and a hydrogen consumption rate of about 70 S $m^3/m^3$ to about 267 S $m^3/m^3$ (400 SCF/B to 1,500 SCF/B). When operated under these conditions using the specified catalyst, hydroconversion conversion is generally ≥25% on a weight basis, e.g., ≥50%.

In certain aspects, the effluent conducted away from the hydroprocessor outlet (at the temperature, pressure, flow rate, etc. present at the hydroprocessor outlet) contains (i) a liquid phase including recoverable fluid and hydroprocessed product, and (ii) a vapor phase including light hydrocarbon gases such as methane, unconverted molecular hydrogen, heteroatom gases such as hydrogen sulfide. The vapor phase is typically separated and conducted away from the hydroprocessed product as an overhead stream. Typically, the vapor phase contains about 5 wt % of the total liquid feed to the reactor. Recoverable fluid can be separated from the hydroprocessed effluent, e.g., for reuse in the process. The recoverable fluid can have, e.g., substantially the same composition and true boiling point distribution as the utility fluid. In certain aspects, the recoverable fluid contains ≥70 wt % of aromatics, ≤10 wt % of paraffins, and having a final boiling point ≤750° C., e.g., ≤510° C., such as ≤430° C. After separation of the recoverable fluid, the remainder of the liquid phase contains a hydroprocessed product having generally desirable blending characteristics compared to those of the hydrocarbon feed.

Initiation of hydroprocessing may also include the use of a primer fluid as described in U.S. Pat. No. 9,777,227, e.g., until sufficient recoverable fluid is available for recycle and reuse. It has been surprisingly discovered that, after a startup transition period, the hydroprocessing process equilibrates so that sufficient fluid to sustain the process (e.g., without any make-up or supplemental fluid from a source external to the process) may be obtained as recoverable fluid from the hydroprocessed effluent.

The Hydroprocessed Effluent

In certain aspects, at least the following components are separated from the hydroprocessed effluent: (i) an overhead stream and (ii) a fluid-enriched stream containing recoverable fluid, and a hydroprocessed product. When the hydrocarbon feed comprises tar, the hydroprocessed product can be called a "hydroprocessed tar". Likewise, when the hydrocarbon feed comprises SCT, the hydroprocessed product can be called a "hydroprocessed SCT". The hydroprocessed product is typically, but not necessarily, removed from the liquid-phase portion of the hydroprocessed effluent as a bottoms fraction. The overhead contains from 0 wt % to about 20 wt % of the hydroprocessed effluent, e.g., from 1 wt % to 15 wt %. The fluid-enriched stream contains from about 20 wt % to about 70 wt % of the hydroprocessed effluent. The hydroprocessed product contains from about 20 wt % to about 70 wt % of the hydroprocessed effluent.

In other aspects, the overhead stream contains from about 5 wt % to about 10 wt % of the hydroprocessed effluent. The fluid-enriched stream contains from about 30 wt % to about 60 wt % of the hydroprocessed effluent. The hydroprocessed product contains from about 30 wt % to about 70 wt % of the hydroprocessed effluent.

The overhead stream, the fluid-enriched stream, and hydroprocessed product can be separated by any separation means, including conventional separations means, e.g., one or more flash drums, splitters, fractionation towers, membranes, absorbents, or any combination thereof, though embodiments are not limited thereto. Fractionation, for example, may be accomplished in one or more distillation towers, or by vapor-liquid separation, for example, by one or more vapor-liquid separators. Describing the separated portions of the hydroprocessed effluent as the overhead stream, the fluid-enriched stream, and hydroprocessed product is not intended to preclude separation in any order or by any particular method of separation. For example, components of the overhead stream and the fluid-enriched stream may be initially separated from the hydroprocessed product as a single stream via a flash drum overhead leaving the desired hydroprocessed product as a flash drum bottoms phase. The overhead and the fluid-enriched stream may later be separated from each other according to any convenient method and the overhead may optionally be carried away for further processing.

The Hydroprocessed Product Portion of the Hydroprocessed Effluent

The hydroprocessed product has an insolubility number, $I_{product}$, less than that of (i) the hydrocarbon feed and typically (ii) less than that of the lower density portion. In particular aspects, the insolubility number, $I_{product}$, of the hydroprocessed product may be ≥20, e.g., ≥30, ≥40, ≥50, ≥60, ≥70, ≥80, ≥90, ≥100, ≥110, ≥120, ≥130, ≥140, or ≥150. Additionally or alternatively, $I_{product}$ may be ≤150, e.g., ≤140, ≤130, ≤120, ≤110, ≤100, ≤90, ≤80, ≤70, ≤60, ≤50, ≤40, or ≤30. Ranges expressly disclosed include combinations of any of the above-enumerated values.

The ratio of the insolubility number of the hydroprocessed product, $I_{product}$, to the insolubility number of the hydrocarbon feed, $I_{feed}$, may be ≤0.90, e.g., ≤0.85, ≤0.80, ≤0.75, ≤0.70, ≤0.65, ≤0.60, ≤0.55, ≤0.50, ≤0.40, ≤0.30, ≤0.20, or ≤0.10. Additionally or alternatively, the ratio may be ≥0.10, e.g., ≥0.20, ≥0.30, ≥0.40, ≥0.50, ≥0.55, ≥0.60, ≥0.65, ≥0.70, ≥0.75, ≥0.80, or ≥0.85. Ranges expressly disclosed include combinations of any of the above-enumerated values.

The ratio of the insolubility number of the hydroprocessed product, $I_{product}$, to the insolubility number of the lower density portion, $I_{LD}$, may be ≤0.95, e.g., ≤0.90, ≤0.85, ≤0.80, ≤0.75, ≤0.70, ≤0.65, ≤0.60, ≤0.55, ≤0.50, ≤0.40, ≤0.30, ≤0.20, or ≤0.10. Additionally or alternatively, ratio may be ≥0.10, e.g., ≥0.20, ≥0.30, ≥0.40, ≥0.50, ≥0.55, ≥0.60, ≥0.65, ≥0.70, ≥0.75, ≥0.80, or ≥0.85. Ranges expressly disclosed include combinations of any of the above-enumerated values.

Blending

One or more of the portions described herein (e.g., lower density portion, treated portion, or hydroprocessed product) or one or more parts thereof, may be designated for blending with a second hydrocarbon, e.g., a heavy hydrocarbon such as one or more fuel oil blend-stocks. When a part of a portion is designated for blending, the part is typically obtained by dividing a stream of the portion, and designating one of the divided streams for blending. Typically all of the "parts" of a stream have substantially the same composition. In particular aspects, the fuel oil blend-stock and designated stream are selected such that the difference between the solubility blending number of the fuel oil-blend-stock, $S_{FO}$, and the insolubility number of the designated stream (e.g., $I_{LD}$, $I_{treated}$, or $I_{product}$ as the case may be) is ≥5 e.g., ≥10, ≥20, or ≥30 or more. Additionally or alternatively, the difference may be ≤30, e.g., ≤20, ≤10. Ranges expressly disclosed include combinations of any of the above-enumerated values; e.g., about 5 wt % to about 30, about 10 to about 30, or about 20 to about 30. In particular aspects, the fuel oil blend stock has a solubility blend number, $S_{FO}$, of ≥50, e.g., ≥60, ≥75, ≥85, ≥90, ≥95, or ≥100. Additionally or alternatively, $S_{FO}$ may be ≤100, e.g., ≤95, ≤90, ≤85, ≤75, or ≤60. Expressly disclosed ranges of $S_{FO}$ include combinations of any of the above-enumerated values, e.g., about 50 to about 100, about 60 to about 100, about 75 to about 100, about 85 to about 100, about 90 to about 100, or about 95 to 100. Non-limiting examples of fuel oil blend stocks suitable for blending with the lower density portion (with or without the fluid) include one or more of bunker fuel, burner oil, heavy fuel oil (e.g., No. 5 or No. 6 fuel oil), high-sulfur fuel oil, low-sulfur fuel oil, regular-sulfur fuel oil (RSFO), and the like. Optionally, trim molecules may be separated, for example, in a fractionator, from bottoms or overhead or both and added to the fluid as desired. The mixture of the fuel oil blend-stock and the desired portion further processed in any manner.

The amount of designated stream that may be included in the blend is not particular. In some aspects, e.g., where the designated stream includes lower density portion, treated portion, and/or hydroprocessed product, the amount of the lower density portion, treated portion, and/or hydroprocessed product may be ≥5 wt %, e.g., ≥10 wt %, ≥20 wt %, ≥30 wt %, ≥40 wt %, ≥50 wt %, ≥60 wt %, ≥70 wt %, ≥80 wt %, or ≥90 wt % or more. Additionally, or alternatively, the amount of the lower density portion, treated portion, and/or hydroprocessed product that may be included in the blend may be ≤80 wt %, ≤70 wt %, ≤60 wt %, ≤50 wt %, ≤40 wt %, ≤30 wt %, ≤20 wt %, or ≤10 wt %. Expressly disclosed ranges of the amount include combinations of any of the above-enumerated values. All of these amounts are based on the total weight the lower density portion, treated portion, and/or hydroprocessed product, as the case may be, that does not form solids in the blend containing the lower density portion, treated portion, and/or hydroprocessed product and the fuel oil blend-stock. In other words, blending the designated stream with the second hydrocarbon does not typically result in asphaltene precipitation, and the blends are generally substantially free of precipitated asphaltenes. Since the higher-density asphaltenes, the ones believed to have a particularly adverse effect on feed hydrocarbon blending, are typically less numerous than the more innocuous lower density asphaltenes, the relative amount of the lower density portion, treated portion, and/or hydroprocessed product may be surprisingly high in some cases, compared to the amount of higher density portion.

Certain aspects will now be described with reference to one or more of the FIGS. The invention is not limited to these aspects, and this description is not meant to foreclose other aspects within the broader scope of the invention. Thus, FIG. 1 schematically illustrates features of a process 100 according to one or more embodiments. In process 100, a hydrocarbon feed is provided via feed line 102. The hydrocarbon feed can be or include tar, such as SCT. The hydrocarbon of line 102 can be one that has been subjected to one or more pre-treatments, e.g., heat soaking and/or steaming. The hydrocarbon feed contains particles that can be removed by centrifuging.

The hydrocarbon feed is blended, mixed, or otherwise combined with a fluid (e.g., utility fluid or one or more solvents), typically provided via line 104, to form a fluid-feed mixture. For example, the hydrocarbon or tar feed can be blended with the utility fluid to reduce viscosity of the hydrocarbon or tar feed and produce a fluid-feed mixture that contains SCT, the particles, and the utility fluid.

Particles (e.g., pyrolytic coke particles, polymeric coke particles, inorganic fines, and/or other solids) in the fluid-feed mixture may optionally be separated in filtration unit 106 before entering a first separation stage 108 (stage 108 containing at least one centrifuge) via inlet 110. The centrifuge of the first separation stage 108 applies heat and a centrifugal force to the fluid-feed mixture sufficient to separate from the fluid-feed mixture a higher density portion and a lower density portion. For example, the fluid-feed mixture can be heated to achieve a temperature of greater than 60°

C. and centrifuged to produce a lower density portion that contains SCT and utility fluid.

An extract containing the higher density portion may exit stage 108 via line 112, e.g., for storage, disposal, or further processing. A raffinate containing the lower density portion exits stage 108 via line 114. In some examples, the extract contains a greater portion of the particles than the raffinate. In one or more examples, the fluid-feed mixture has a first concentration of the particles having a size of greater than 25 μm and the lower density portion has a second concentration of the particles having a size of greater than 25 μm. The second concentration can be in a range from about 50% to about 99.9% of the first concentration. In some examples, the lower density portion contains at least 75%, at least 80%, at least 85%, at least 90%, at least 95%, at least 98%, or at least 99% less of the particles as the fluid-feed mixture. These concentrations are on a weight basis, but typically do not vary significantly from the indicated values when based on volume or number.

Optionally, the raffinate is filtered in a second filtration unit 116 before entering optional second separation stage 118. Optional second separation unit 118 preferably separates from the raffinate a fluid-enriched stream 120 that may be recycled to the process, e.g., to fluid line 104. A second raffinate, which typically, but not necessarily (particularly where solvent assisted hydroprocessing is desired), contains the remainder of the first raffinate after separation of the fluid-enriched stream can exit the optional second separation unit via line 122. The second raffinate can be removed from the process, e.g., for storage and/or further processing, such as blending with other hydrocarbon feed or fuel oil. In certain aspects, a separation fluid is included in the fluid-feed mixture, the separation fluid and utility fluid being compositionally different, and having substantially non-overlapping normal boiling point ranges. In these aspects at least a portion of the separation fluid is recovered via line 120 for re-use in the centrifuging, with at least a portion of the utility fluid remaining in the raffinate, e.g., for use as a processing aid during subsequent hydroprocessing.

Figure 2:
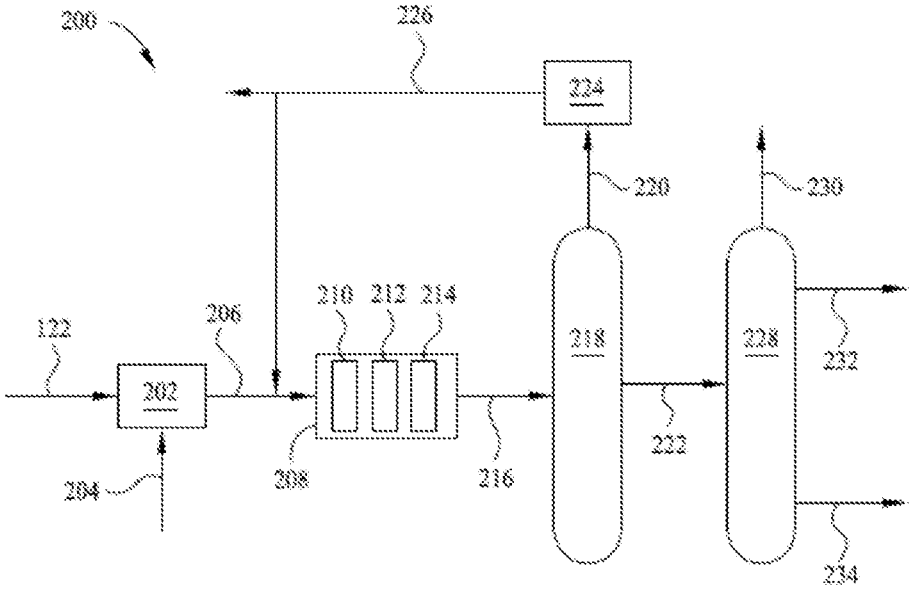
FIG. 2 depicts a process 200, according to one or more embodiments.

FIG. 2 schematically illustrates a process 200 according to one or more embodiments. In FIG. 2, the contents in line 122 (e.g., the second raffinate of FIG. 1) may be conducted to preheat stage 202. A treat gas containing molecular hydrogen is obtained from one or more conduits 204. Optionally, the treat gas is heated before it is combined with the second raffinate. The treat gas can be combined with the second raffinate in stage 202, as shown in FIG. 2, but this is not needed. In other aspects, at least a portion of the treat gas is combined with the second raffinate upstream and/or downstream of stage 202. The mixture of second raffinate+ treat gas is then conducted via conduit 206 to hydroprocessing stage 208. Mixing means can be utilized for combining the pre-heated second raffinate mixture with the pre-heated treat gas in hydroprocessing stage 208, e.g., mixing means may be one or more gas-liquid distributors of the type conventionally utilized in fixed bed reactors. The mixture is hydroprocessed in the presence of optional primer fluid, and one or more of the specified hydroprocessing catalysts, the hydroprocessing catalyst being deployed within hydroprocessing stage 208 in at least one catalyst bed 210. Additional catalyst beds, e.g., 212, 214 with intercooling quench using treat gas, from conduit 202, can be provided between beds, if desired. The hydroprocessing conditions and choice of primer fluid, and when one is utilized, can be the same as those specified in U.S. Pat. No. 9,809,756.

Hydroprocessed effluent is conducted away from stage 208 via conduit 216 to a third separation stage 218 for separating from the hydroprocessor effluent (i) a vapor-phase product 220 (the total vapor product, which contains, e.g., heteroatom vapor, vapor-phase cracked products, unused treat gas, or any combination thereof) and (ii) a liquid-phase product 222 which contains, e.g., recoverable fluid and hydroprocessed product, such as hydroprocessed tar. Third separation stage 218 can include one or more conventional separators, e.g., one or more flash drums, but embodiments are not limited thereto. In a particular aspect, the amount (determined at room temperature) of liquid-phase product is about 95 wt % of the total liquid feed (combined fluid and hydrocarbon feed from conduit 110) to stage 208.

The vapor-phase product may be conducted away from stage 218 via conduit 220 for further processing, e.g., to upgrading stage 224, e.g., for $H_2S$ removal. Molecular hydrogen obtained from stage 224, optionally in the presence of light hydrocarbon vapor and other vapor diluent, can be re-cycled for re-use as a treat gas component via conduit 226 to the hydroprocessing stage 208, or purged as indicated.

The liquid-phase product, which typically constitutes the remainder of the hydroprocessed effluent, is conducted away from stage 218 via conduit 222 to fourth separation stage 228. A bottoms stream containing from about 20 wt % to about 70 wt % of the liquid phase conducted to stage 228 can be separated and carried away via conduit 234, e.g., for storage and/or further processing, such as blending with a second hydrocarbon. A second vapor phase, which includes, e.g., an overhead stream containing from 0 wt % to about 20 wt % of the liquid phase, can be separated and carried away via conduit 230. The second vapor phase, which is primarily vapor dissolved or entrained in the liquid phase 222, typically contains $C_4$-fuel gas, which may optionally be combined with vapor phase product in conduit 220, if desired. A fluid-enriched stream containing recoverable fluid is separated and conducted via conduit 232 for re-cycle and re-use, e.g., via line 102 of FIG. 1.

EXPERIMENTAL

Figure 4:
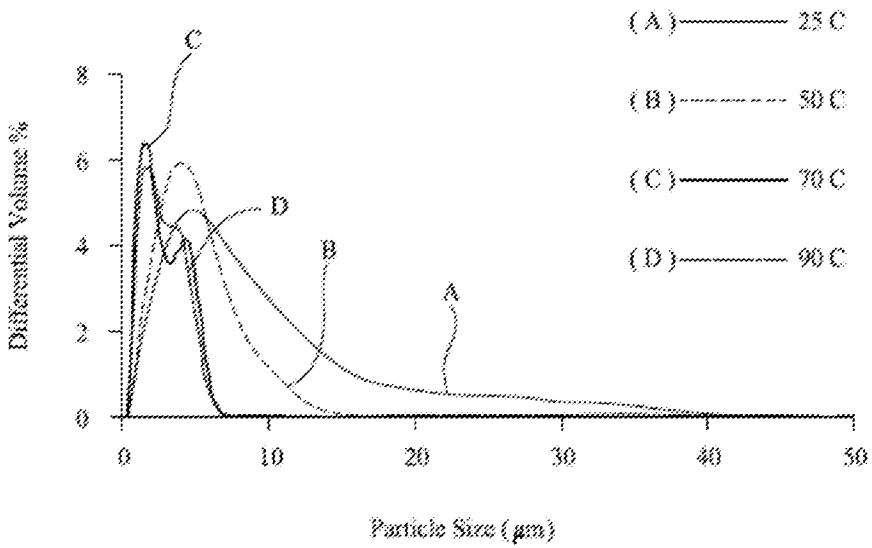
FIG. 4 depicts a particle size distribution chart that provides a comparison of the differential volume percent versus particle sizes for the polymeric coke particles as a function of temperature during centrifugation, according to one or more embodiments.

FIG. 4 depicts a particle size distribution chart that provides a comparison of the differential volume percent versus particle sizes for coke particles in a raffinate separated by centrifuging a fluid-feed mixture. The feed to the centrifuging is a fluid-feed mixture comprising SCT (60 wt %) and utility fluid (40 wt %). The centrifuging is carried out with the fluid-feed mixture at four different temperature values during centrifuging: 25° C. (A), 50° C. (B), 70° C. (C), and 90° C. (D). The results in FIG. 4 show that as the temperature is increased from 25° C. to 90° C., the tail of the particle size distribution is substantially reduced from (A) to (D). The presence of coke particles of size greater than 25 μm, as indicated in the tail portion of the distribution (A), would lead to premature plugging of hydroprocessing units if allowed to continue to flow downstream. However, for the samples centrifuged at a temperature ≥60° C., i.e., at 70° C. (C), and 90° C. (D), no appreciable amount of coke particles of size greater than 25 μm is detected in the raffinate, such as the lower density portion.

Figure 5:
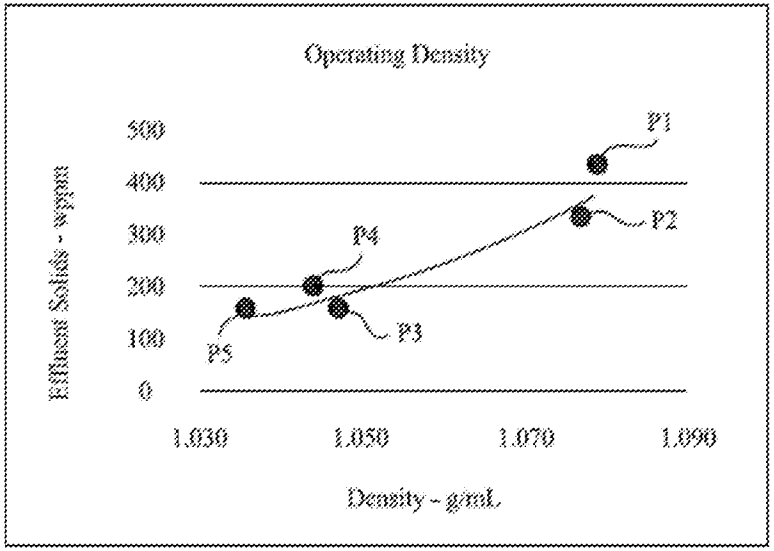
FIG. 5 depicts a chart that provides a comparison of effluent solids versus density for the polymeric coke particles as a function of temperature during centrifugation, according to one or more embodiments.

FIG. 5 depicts a chart that provides a comparison of effluent solids versus density for the polymeric coke particles as a function of temperature during centrifugation, according to one or more embodiments. The composition of the SCT, the utility fluid, and the fluid-feed mixture are held constant. The centrifuging is carried out at a temperature of 35° C. (P5), 46° C. (P4), 57° C. (P3), 68° C. (P2), and 80°

C. (P1). The Y axis represents the amount of solids (ppm, weight basis) in the extract (the high density portion) conducted away from the centrifuge. The X axis represents the density of the extract. As shown in FIG. 5, when the fluid-feed mixture is centrifuged at a temperature >60° C., the density of the extract increases and the amount of solids transferred from the fluid-feed mixture to the extract increases, resulting in about 50% greater amount of solids in the extract.

Figure 6:
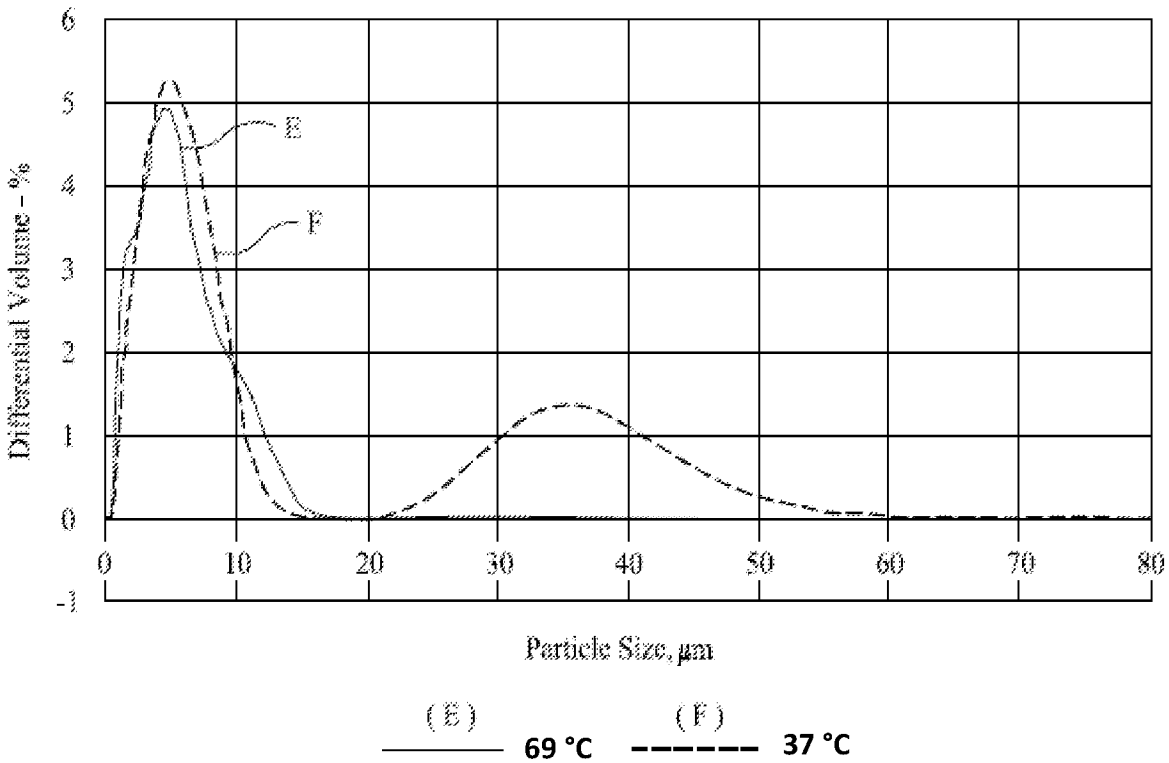
FIG. 6 depicts another particle size distribution chart that provides a comparison of the differential volume percent versus particle sizes for the polymeric coke particles as a function of temperature during centrifugation, according to one or more embodiments.

FIG. 6 depicts a particle size distribution chart that provides a comparison of the differential volume percent versus particle sizes for coke particles as a function of temperature during centrifugation, according to one or more embodiments. The results in FIG. 6 show the particle size distribution when the temperature of the process is at the two different values of 37° C. (F) and 69° C. (E). As the temperature is increased from 37° C. to 69° C., the tail of the particle size distribution is substantially reduced from (F) to (E). The coke particles of size greater than 25 μm, as indicated in the tail portion of the distribution (F), would lead to premature plugging of hydroprocessing units if allowed to continue to flow downstream. However, for the samples centrifuged at 69° C. (E), no appreciable amount of coke particles of size greater than 25 μm is detected in the raffinate, such as the lower density portion.

Overall, embodiments provide processes that include the discovery to preferentially remove, particularly by heating a temperature of greater than 60° C. and centrifuging, certain higher density components (e.g., particles) in the hydrocarbon feed results in a feed having less impurities. Heating and centrifuging segregates the particles that tend to cause fouling of downstream catalysts and other portions of the process system, allowing for acceptable yields by leaving useful components in the lower density portion. In some embodiments, the process is based in part on the discovery that separation from the feed of a higher density portion, e.g., by heating and centrifuging, can increase the compatibility of hydrocarbon feed to a greater extent while removing a relatively smaller amount of the feed, leading to a purer product stream.

All documents described herein are incorporated by reference herein for purposes of all jurisdictions where such practice is allowed, including any priority documents and/or testing procedures to the extent they are not inconsistent with this text. As is apparent from the foregoing general description and the specific aspects, while forms of the invention have been illustrated and described, various modifications can be made without departing from the spirit and scope of the invention. Accordingly, it is not intended that the invention be limited thereby. Likewise, the term "comprising" is considered synonymous with the terms "including" and "containing". Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below.

What is claimed is:

1. A process for preparing a low particulate liquid hydrocarbon product comprising:

blending a hydrocarbon feed comprising particles with a fluid to produce a fluid-feed mixture comprising tar, the particles, and the fluid, wherein the fluid-feed mixture has a solubility blending number of 70 to 130; and centrifuging the fluid-feed mixture at a temperature of greater than 60° C. to produce a higher density portion and a lower density portion, wherein at least 75% by weight of the particles are transferred from the fluid-feed mixture to the higher density portion, based on the weight of the particles in the fluid-feed mixture, and wherein the higher density portion contains ≤5 wt % of the total weight of the hydrocarbon feed present in the fluid-feed mixture.

2. The process of claim 1, wherein at least 90% by weight of the particles are transferred from the fluid-feed mixture to the higher density portion.

3. The process of claim 1, wherein the lower density portion comprises about 100 ppmw or less of particles having a size of greater than 25 μm, based on the weight of the lower density portion.

4. The process of claim 1, wherein the lower density portion is substantially free of particles of size greater than 25 μm.

5. The process of claim 1, wherein the particles have a specific gravity from about 1.04 to about 1.5.

6. The process of claim 1, wherein the particles comprise polymeric coke particles and non-polymeric coke particles selected from the group consisting of polymeric asphaltene particles, pyrolytic coke particles, and inorganic fines, wherein the hydrocarbon feed comprises the tar, and wherein the tar comprises steam cracker tar.

7. The process of claim 6, wherein the polymeric coke particles have a specific gravity of 1.04.

8. The process of claim 1, further comprising hydroprocessing at least a portion of the lower density portion.

9. A process for preparing a low particulate liquid hydrocarbon product comprising:

blending a tar stream comprising particles with a fluid to produce a fluid-feed mixture comprising tar, the particles, and the fluid, wherein the fluid-feed mixture comprises greater than 500 ppmw of the particles having a size of greater than 25 μm, based on the weight of the fluid-feed mixture, and wherein the fluid-feed mixture has a solubility number of 70 to 130; and centrifuging the fluid-feed mixture at a temperature of greater than 60° C. to produce a higher density portion and a lower density portion, wherein:

the higher density portion contains ≤5 of the total weight of the hydrocarbon feed present in the fluid-feed mixture, and the lower density portion comprises ≤25% of the particles in the fluid-feed mixture, based on the weight of particles in the feed-fluid mixture, or the lower density portion comprises ≤500 ppmw of particles having a size of greater than 25 μm, based on the weight of the lower density portion.

10. The process of claim 9, wherein the lower density portion comprises about 250 ppmw or less of particles having a size >25 μm, based on the weight of the lower density portion.

11. The process of claim 9, wherein the fluid comprises a solvent selected from the group consisting of benzene, ethylbenzene, trimethylbenzene, xylenes, toluene, naphthalenes, alkylnaphthalenes, tetralins, alkyltetralins, and any combination thereof.

12. The process of claim 9, wherein the fluid-feed mixture is centrifuged at a temperature of greater than 60° C. to about 200° C.

13. The process of claim 12, wherein the particles of the fluid-feed mixture have a specific gravity from about 1.04 to about 1.5.

14. A process for preparing a low particulate liquid hydrocarbon product comprising:

blending an SCT comprising particles with a fluid to produce a fluid-feed mixture comprising tar, the particles, and the fluid, wherein the fluid-feed mixture comprises greater than 500 ppm of the particles having a size of greater than 25 μm, wherein the particles have a specific gravity from about 1.04 to about 1.5, and wherein the fluid-feed mixture has a solubility blending number of 70 to 130; and centrifuging the fluid-feed mixture at a temperature of greater than 60° C. to produce a higher density portion and a lower density portion, wherein the lower density portion comprises 500 ppmw or less of the particles having a size of greater than 25 μm, based on the weight of the lower density portion, and wherein the higher density portion contains ≤5 wt % of the total weight of the hydrocarbon feed present in the fluid-feed mixture.

15. The process of claim 14, wherein the fluid-feed mixture is centrifuged at a temperature of greater than 60° C. to about 200° C.

16. The process of claim 14, wherein the lower density portion comprises no more than 2 wt % of the particles in the fluid-feed mixture, based on the weight of the particles in the fluid-feed mixture.

17. The process of claim 14, wherein the lower density portion is substantially free of particles having a size of greater than 25 μm.

18. The process of claim 14, wherein the lower density portion comprises about 250 ppmw or less of particles having a size of greater than 25 μm, based on the weight of the lower density portion.

19. The process of claim 1, wherein the fluid-feed mixture is centrifuged at a temperature of greater than 100° C. to about 220° C.

20. The process of claim 1, wherein the fluid-feed mixture is centrifuged at a temperature of 110° C. to about 220° C.

21. The process of claim 1, wherein the fluid-feed mixture is centrifuged at a temperature of 120° C. to about 220° C.

22. The process of claim 1, wherein the solubility blending number of the fluid-feed mixture is 70 to 120.

23. The process of claim 1, wherein the higher density portion contains ≤2 wt % of the total weight of the hydrocarbon feed present in the fluid-feed mixture.

24. The process of claim 1, wherein:

the fluid-feed mixture is centrifuged at a temperature of greater than 100° C. to about 220° C., and the higher density portion contains ≤2 wt % of the total weight of the hydrocarbon feed present in the fluid-feed mixture.

25. The process of claim 1, wherein:

the particles in the hydrocarbon feed comprise polymeric coke particles and non-polymeric coke particles, the non-polymeric coke particles are selected from the group consisting of polymeric asphaltene particles, pyrolytic coke particles, and inorganic fines, and the process further comprises subjecting a mixture comprising a stream cracker tar comprising olefinic molecules and a quench oil comprising olefinic molecules to conditions sufficient to cause the olefinic molecules in the mixture to oligomerize and/or polymerize to produce the polymeric coke particles in the hydrocarbon feed.

* * * * *